US010167057B1

(12) United States Patent
Terada et al.

(10) Patent No.: US 10,167,057 B1
(45) Date of Patent: Jan. 1, 2019

(54) JET BOAT

(71) Applicant: YAMAHA HATSUDOKI KABUSHIKI KAISHA, Iwata, Shizuoka (JP)

(72) Inventors: Kohei Terada, Shizuoka (JP); Michael Ortiz, Kennesaw, GA (US)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/682,915

(22) Filed: Aug. 22, 2017

(51) Int. Cl.

| | |
|---|---|
| ***B63B 1/32*** | (2006.01) |
| ***B63B 35/73*** | (2006.01) |
| ***B63B 29/02*** | (2006.01) |
| *B63B 35/85* | (2006.01) |

(52) U.S. Cl.
CPC ..... *B63B 1/32* (2013.01); *B63B 29/02* (2013.01); *B63B 35/73* (2013.01); *B63B 2035/855* (2013.01)

(58) Field of Classification Search
CPC ..... B63H 25/00; B63H 25/42; B63H 25/46; B63H 5/00; B63H 5/14; B63H 11/00; B63H 11/11; B63H 11/08; B63H 11/103; B63H 11/113; B63H 11/213
USPC ..... 114/151; 440/40, 41, 42, 46, 47
See application file for complete search history.

(56) References Cited

U.S. PATENT DOCUMENTS

| | | | | |
|---|---|---|---|---|
| 5,090,929 | A * | 2/1992 | Rieben | B63H 5/14 114/151 |
| 7,641,525 | B2 * | 1/2010 | Morvillo | B63H 25/42 440/42 |
| 9,376,188 | B2 | 6/2016 | Okamoto | |
| 9,623,943 | B2 | 4/2017 | Anma | |
| 2011/0067616 | A1 | 3/2011 | Snow, Jr. | |
| 2014/0096505 | A1 | 4/2014 | Okamoto | |
| 2016/0244126 | A1 | 8/2016 | Fafard et al. | |

FOREIGN PATENT DOCUMENTS

| | | | |
|---|---|---|---|
| JP | 06-024388 | A | 2/1994 |
| JP | 2014-073790 | A | 4/2014 |
| JP | 2014-080083 | A | 5/2014 |

* cited by examiner

*Primary Examiner* — Lars A Olson
(74) *Attorney, Agent, or Firm* — Global IP Counselors, LLP

(57) ABSTRACT

A jet boat basically includes a hull, a first jet propulsion unit, a second jet propulsion unit, and a steering unit. The first jet propulsion unit is provided to the hull. The first jet propulsion unit has a first steering deflector with a first propulsion axis. The first steering deflector is movable with respect to the hull. The second jet propulsion unit is provided to the hull. The second jet propulsion unit has a second steering deflector with a second propulsion axis. The second steering deflector is movable with respect to the hull. The steering unit is operatively coupled to the first and second jet propulsion units. The first and second steering deflectors are oriented such that the first and second propulsion axes are non-parallel to a longitudinal center axis of the hull while the steering unit is in a straight steering position.

18 Claims, 13 Drawing Sheets

JET BOAT

BACKGROUND

Field of the Invention

The present invention generally relates to the field of jet boats.

Background Information

Recently, surface water sports, such as a wakeboarding, a wakesurfing, and the like, have become popular. In such surface water sports, a rider trails behind a boat while riding the boat's wake. Specifically, the wakeboarding is a water sport in which a rider is directly towed behind a boat using a rope with a grip handle, and rides a wakeboard over the boat's wake. The wakesurfing is a water sport in which a rider trails behind a boat while riding a surfboard over the boat's wake without being directly towed by the boat.

Conventionally, some boats are provided with structures for creating suitable wake for the water sports. Specifically, U.S. Patent Application Publication No. 2016/0244126 discloses an aft platform as an extension or an attachment to a hull or deck of a boat to generate the suitable wake for the wakesurfing. In this case, the shape of the wake is basically determined by the shape of the surface of the aft platform that sits in the water.

SUMMARY

Boats are used for many purposes in different styles. However, once the above-mentioned aft platform for the wakesurfing is installed on the boat, it is difficult to use the boat for purposes other than the wakesurfing since it is impossible or bothersome to remove the aft platform from the boat. Furthermore, it is desirable that the boat creates different shapes of wakes for various purposes. However, as mentioned above, the shape of the wake is basically determined by the shape of the aft platform. Thus, it is difficult to generate different shapes of wakes with the above-mentioned aft platform.

Generally, the present disclosure is directed to various features of a jet boat that generates suitable wake for various purposes.

In accordance with one aspect of the present disclosure, a jet boat basically includes a hull, a first jet propulsion unit, a second jet propulsion unit and a steering unit. The first jet propulsion unit is provided to the hull. The first jet propulsion unit has a first steering deflector with a first propulsion axis. The first steering deflector is movable with respect to the hull. The second jet propulsion unit is provided to the hull. The second jet propulsion unit has a second steering deflector with a second propulsion axis. The second steering deflector is movable with respect to the hull. The steering unit is operatively coupled to the first and second jet propulsion units. The first and second steering deflectors are oriented such that the first and second propulsion axes are non-parallel to a longitudinal center axis of the hull while the steering unit is in a straight steering position.

In accordance with another aspect of the present disclosure, a jet boat basically includes a hull, a first jet propulsion unit, a second jet propulsion unit and a user control switch. The first jet propulsion unit is provided to the hull. The first jet propulsion unit has a first steering deflector with a first propulsion axis. The first steering deflector is movable with respect to the hull. The second jet propulsion unit is provided to the hull. The second jet propulsion unit has a second steering deflector with a second propulsion axis. The second steering deflector is movable with respect to the hull. The user control switch is operatively coupled to at least one of the first and second jet propulsion units to adjust a tilt of at least one of the first and second propulsion axes with respect to a vertical direction.

Also other features, aspects and advantages of the disclosed jet boat will become apparent to those skilled in the field of manufacturing boats from the following detailed description, which, taken in conjunction with the annexed drawings, discloses several illustrative embodiments of a jet boat with various features.

BRIEF DESCRIPTION OF THE DRAWINGS

Referring now to the attached drawings which form a part of this original disclosure.

Figure 1:
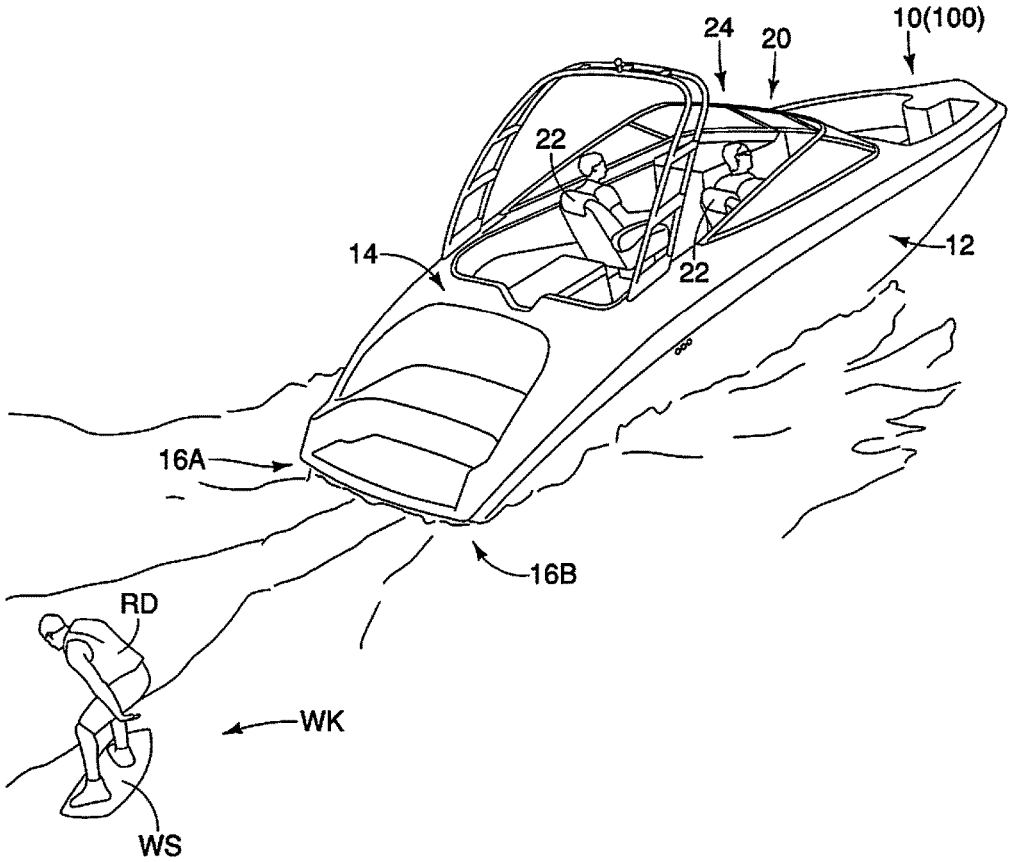
FIG. 1 is a perspective view of a boat in accordance with a first embodiment, illustrating a rider trails behind the boat while riding a surfboard over the boat's wake without being directly towed by the boat.

It should be noted that these figures are intended to illustrate the general characteristics of methods, structure and/or materials utilized in certain illustrative embodiments and to supplement the written description provided below. These drawings are not, however, to scale and may not precisely reflect the precise structural or performance characteristics of any given embodiment, and should not be interpreted as defining or limiting the range of values or properties encompassed by illustrative embodiments. The use of similar or identical reference numbers in the various drawings is intended to indicate the presence of a similar or identical element or feature.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents. Like reference numerals in the drawings denote like similar or identical elements or features, and thus the descriptions of the similar or identical elements or features may be omitted in later embodiments.

First Embodiment

Referring initially to FIG. 1, a boat 10 is illustrated in accordance with a first embodiment. As illustrated in FIG. 1, the boat 10 is a jet boat propelled by water jets ejected from the boat 10. Basically, the boat 10 includes a hull 12, a deck 14 and a pair of jet propulsion units 16A and 16B (e.g., first and second jet propulsion units).

Figure 2:
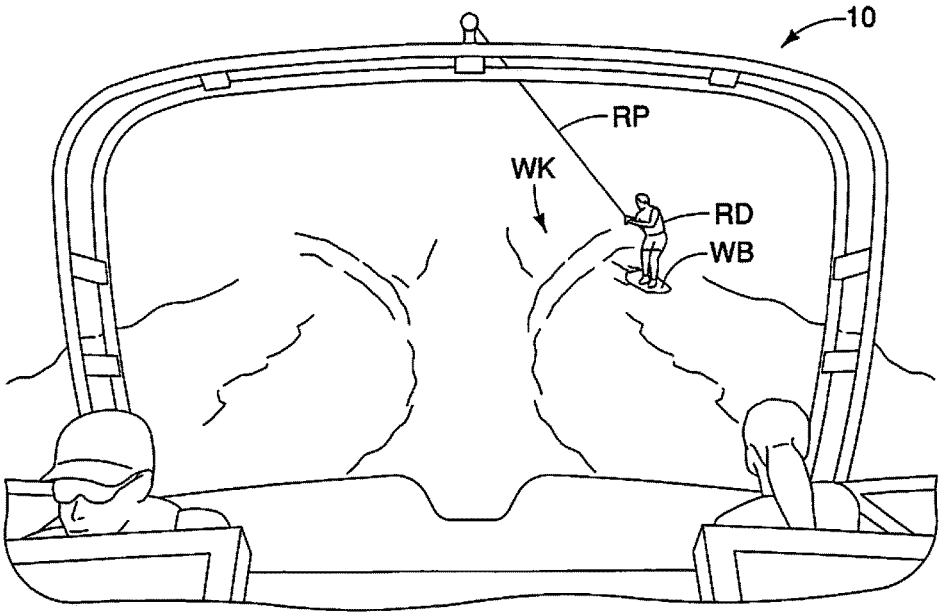
FIG. 2 is a schematic diagram of the boat generating a shorter boat's wake for wakeboarding, illustrating a rider riding a wakeboard over the boat's wake while being directly towed behind the boat using a rope.
Figure 3:
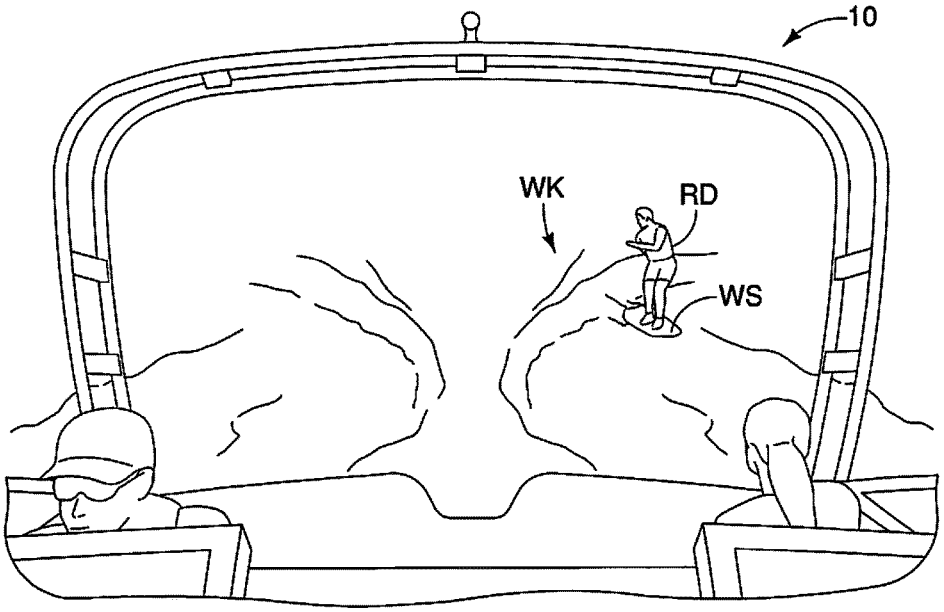
FIG. 3 is a schematic diagram of the boat generating a higher boat's wake for wakesurfing, illustrating a rider riding a surfboard over the boat's wake without being directly towed by the boat.

In the illustrated embodiment, the jet propulsion units 16A and 16B are operated to generate a boat's wake WK suitable for surface water sports, such as a wakeboarding, a wakesurfing, and the like. In such surface water sports, as shown in FIG. 1, a rider RD trails behind the boat 10 while riding the boat's wake WK. In particular, as illustrated in FIG. 2, for the wakeboarding, the rider RD is directly towed behind the boat 10 using a rope RP with a grip handle, and rides a wakeboard WB over the boat's wake WK. For example, the rider RD trails behind the boat 10 by the distance of about 10 to 15 meters for the wakeboarding. On the other hand, as illustrated in FIG. 3, for the wakesurfing, the rider RD trails behind the boat 10 while riding a surfboard WS over the boat's wake WK without being directly towed by the boat 10. For example, the rider RD trails behind the boat 10 by the distance of about 2 to 5 meters. In the illustrated embodiment, the boat's wake WK created for the wakeboarding (FIG. 2) is shorter in the height and longer in the length than the boat's wake WK created for the wakesurfing (FIG. 3). Of course, the shape of the boat's wake WK is not limited to this wake, and the boat's wake WK can be created in different manner as needed and/or desired for different purposes.

In the illustrated embodiment, the shape of the boat's wake WK is changed by changing the directions of the water jets ejected from the jet propulsion units 16A and 16B according to a selected operation mode of the jet propulsion units 16A and 16B. The operation of the jet propulsion units 16A and 16B for changing the directions of the water jets to obtain desired boat's wake WK will be described in detail later.

As illustrated in FIG. 1, the deck 14 is provided on the hull 12 in a conventional manner. Preferably, the hull 12 and the deck 14 are integrated to form a unit. The hull 12, the deck 14 and the other parts of the boat 10 are made of suitable materials that are typically used in boats for a marine environment, for example, and thus, the materials of the various parts of the boat 10 will not be discussed herein.

As illustrated in FIG. 1, the deck 14 includes a cockpit 20 that has a plurality of (two in FIG. 1) cockpit seats 22 and a boat control system 24. In the illustrated embodiment, the cockpit seats 22 each have a seat base, a backrest, a headrest and an armrest. Of course, the cockpit seats 22 can be different types of seats, such as a bench seat, a bucket or semi-bucket seat, and the like.

Figure 4:
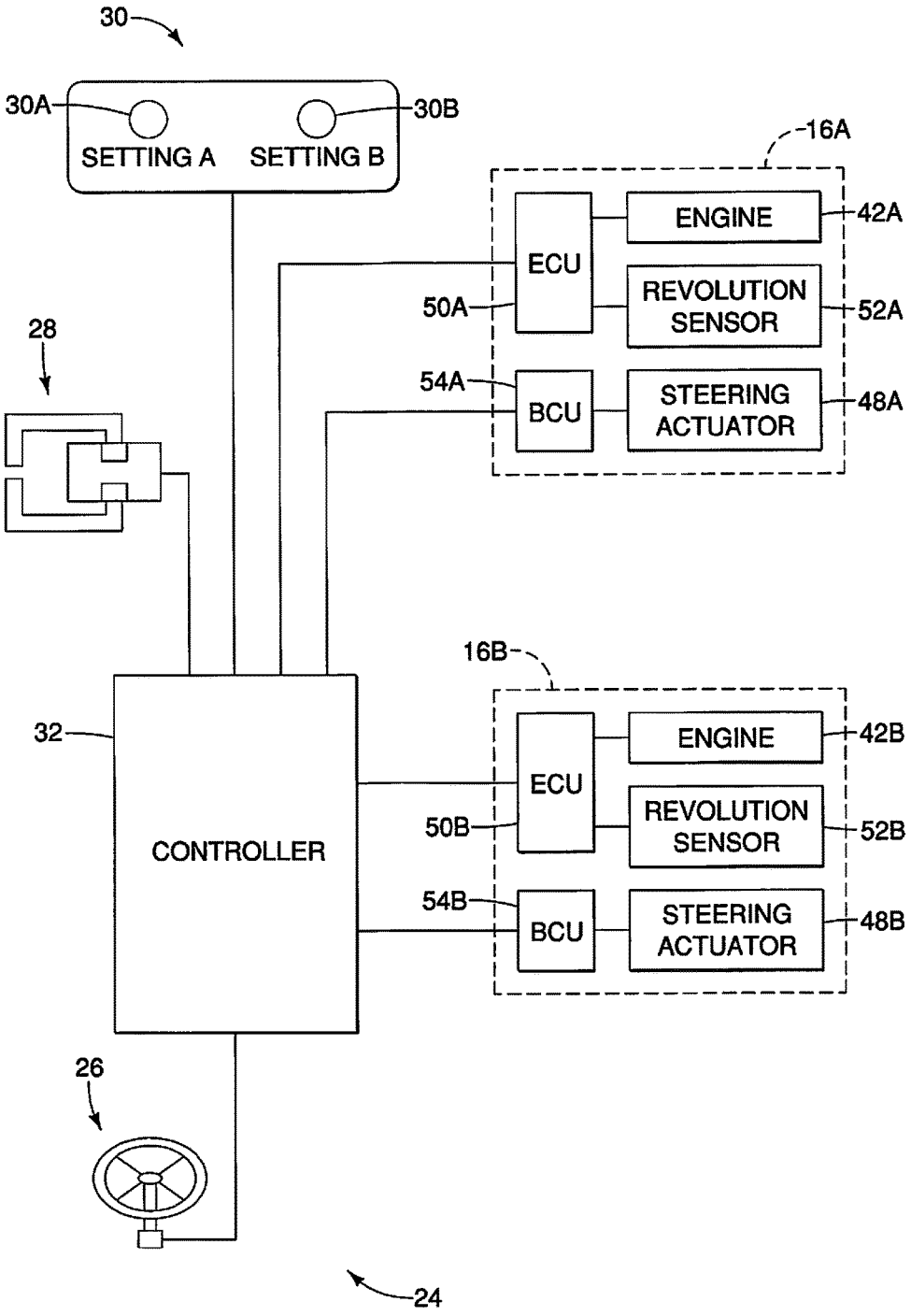
FIG. 4 is a block diagram of a boat control system of the boat illustrated in FIG. 1.

As illustrated in FIG. 4, the boat control system 24 includes a steering or helm 26 (e.g., steering unit), a remote control 28, a control switch 30 (e.g., a user control switch) and a controller 32 (e.g., an electronic controller). The boat control system 24 includes a drive-by-wire system for operating the boat 10, and is configured to perform various operations of the boat 10. Specifically, in the boat control system 24, the steering 26, the remote control 28 and the control switch 30 are electrically connected to the controller 32 to send operation signals to the controller 32. In response, the controller 32 operates the jet propulsion units 16A and 16B to control the boat 10.

In the illustrated embodiment, the steering 26 has a steering wheel. The steering 26 is used by an operator or user to turn the boat 10. Specifically, the steering 26 is electrically connected to the controller 32. Thus, the steering 26 is operatively coupled to the jet propulsion units 16A and 16B via the controller 32. The steering 26 outputs the operation signal (steering signal) to the controller 32 according to the steering operation (steering angle) of the steering 26 by the operator. More specifically, when the steering 26 is positioned in a straight steering position, the controller 32 operates the jet propulsion units 16A and 16B such that the jet propulsion units 16A and 16B are positioned in non-steered or neutral positions, respectively, that steers the boat 10 straight. Also, when the steering 26 is turned right (in the clockwise direction) from the straight steering position, the controller 32 operates the jet propulsion units 16A and 16B to steer the boat 10 to the right. Also, when the steering 26 is turned left (in the counterclockwise direction) from the straight steering position, the controller 32 operates the jet propulsion units 16A and 16B to steer the boat 10 to the left. The remote control 28 is used by the user to independently control the shifts (forward position/reverse position/neutral position) and the throttle (propulsion forces) of the jet propulsion units 16A and 16B. The remote control 28 is electrically connected to the controller 32. The remote control 28 outputs the operation signal (control signal) indicative of the shifts and the throttle to the controller 32 according to the user operation of the remote control 28. The remote control 28 is relatively conventional, and thus, will not described in detail for the sake of brevity.

The control switch 30 includes a plurality of (two in FIG. 4) buttons 30A and 30B (e.g., user input devices). The buttons 30A and 30B are push-buttons that are used by the operator to select an operation mode of the jet propulsion units 16A and 16B from among selectable operation modes for generating desired boat's wake WK. In the illustrated embodiment, as illustrated in FIG. 4, the button 30A is used to select a "setting A" of the operation mode, while the button 30B is used to select a "setting B" of the operation mode. In particular, in the illustrated embodiment, the setting A of the button 30A corresponds to a "toe-in thrust mode" of the operation mode of the jet propulsion units 16A and 16B, while the setting B of the button 30B corresponds to a "toe-out thrust mode" of the operation mode of the jet propulsion units 16A and 16B. The operation modes of the jet propulsion units 16A and 16B for generating the desired boat's wake WK will be described in detail later. In the illustrated embodiment, the control switch 30 has a switch mechanism (i.e., push-buttons), but is not limited to this configuration. The control switch 30 can be displayed on a touch screen display (not shown) as a GUI (Graphical User Interface), and can be operated by a user touch operation. The control switch 30 outputs the operation signal to the controller 32 according to the user operation of the buttons 30A and 30B.

The controller 32 includes a microcomputer or a processor, such as a CPU (Central Processing Unit). The controller 32 can also include other conventional components such as an input interface circuit, an output interface circuit, and a memory such as a ROM (Read Only Memory) and a RAM (Random Access Memory). The processor of the controller 32 is programmed to control the various components of the boat 10. The memory of the controller 32 stores processing results and control programs such as ones for controlling the boat 10. For example, the RAM stores statuses of operational flags and various control data, while the ROM stores the control programs for various operations. It will be apparent to those skilled in the art from this disclosure that the precise structure and algorithms for the controller 32 can be any combination of hardware and software that will carry out the functions discussed herein.

In the illustrated embodiment, the controller 32 is programmed to control the jet propulsion units 16A and 16B in accordance with the operation signals from the steering 26, the remote control 28 and the control switch 30. The basic controls of the jet propulsion units 16A and 16B in accordance with the operation signals from the steering 26 and the remote control 28 are relatively conventional, and thus, will not be discussed in detail herein. The controller 32 can also be programmed to navigate the boat 10 based on detection results of sensors, such as a heading sensor and a position sensor in a conventional manner.

Figure 5:
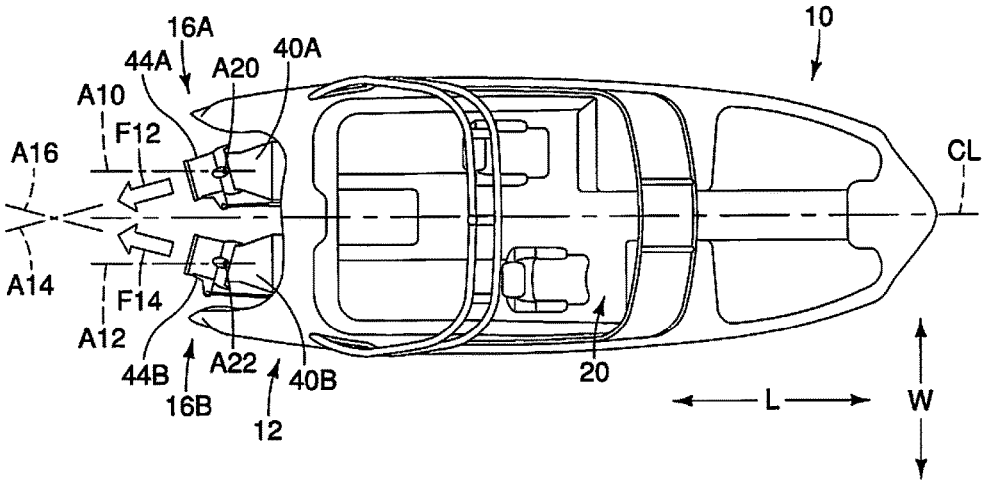
FIG. 5 is a top plan view of the boat, partially cut away to illustrate the orientation of steering nozzles of jet propulsion units of the boat, illustrating the boat is operated in a toe-in thrust mode.
Figure 6:
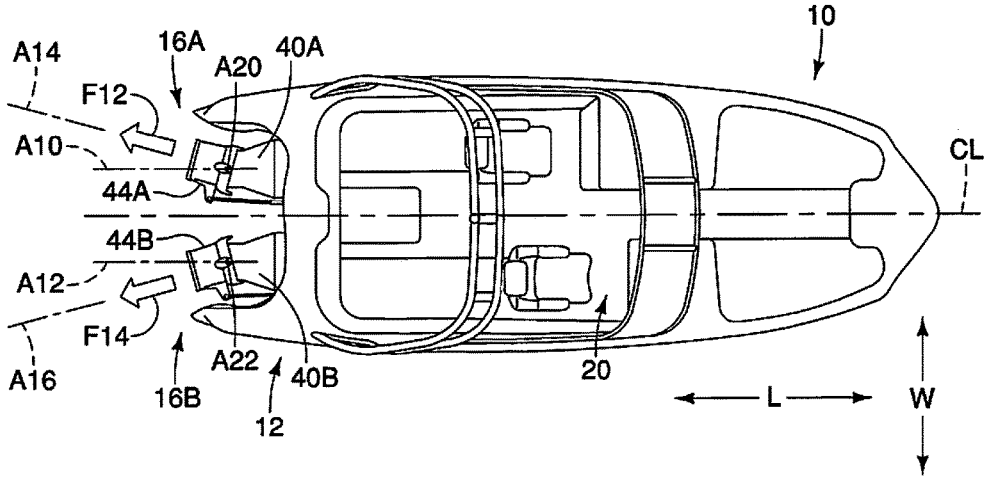
FIG. 6 is a top plan view of the boat, partially cut away to illustrate the orientation of the steering nozzles of the jet propulsion units of the boat, illustrating the boat is operated in a toe-out thrust mode.

As illustrated in FIGS. 5 and 6, the jet propulsion units 16A and 16B are provided to a rear portion of the hull 12. The jet propulsion units 16A and 16B are laterally arranged relative to each other. Specifically, the jet propulsion units 16A and 16B are arranged along a lateral or widthwise direction W of the boat 10 relative to each other. The widthwise direction W of the boat 10 is perpendicular to a fore-to-aft or lengthwise direction L of the boat 10 that extends along a longitudinal center axis CL of the boat 10. In the illustrated embodiment, the left side jet propulsion unit 16A (e.g., the first jet propulsion unit) is located laterally on the left side (port) of the boat 10 relative to the longitudinal center axis CL of the boat 10. The right side jet propulsion unit 16B (e.g., the second jet propulsion unit) is located laterally on the right side (starboard) relative to the longitudinal center axis CL of the boat 10.

As illustrated in FIGS. 4 to 9, the left side jet propulsion unit 16A generally includes a jet pump 40A, an engine 42A, a steering deflector or nozzle 44A (e.g., a first steering deflector), a steering link 46A and a steering actuator 48A. The left side jet propulsion unit 16A also include a reversing bucket (not shown) or any other conventional parts, which are not shown in the drawings for the sake of brevity.

The engine 42A is installed inside the hull 12, and generates a driving force or power. The engine 42A is mechanically coupled to the jet pump 40A in a conventional manner to transmit the driving force of the engine 42A to the jet pump 40A. The jet pump 40A is mounted to the hull 12. The jet pump 40A generates propulsion force or thrust F12 to propel the boat 10 based on the driving force of the engine 42A. Specifically, the jet pump 40A draws water through an intake grid (inlet) at the bottom of the hull 12, and discharges the water through the outlet of the steering nozzle 44A to generate the propulsion force F12. The steering link 46A includes a cable or wire (e.g., a Bowden cable) that mechanically links the steering nozzle 44A with the steering actuator 48A. The steering actuator 48A includes a motor or other type of actuator that operates the steering nozzle 44A via the steering link 46A in response to the control signal from the controller 32. Of course, the steering link 46A can alternatively include a hydraulic cylinder that links the steering nozzle 44A with the steering actuator 48A. In this case, the steering actuator 48A includes a hydraulic pump that operates the steering nozzle 44A via the steering link 46A in response to the control signal from the controller 32. The left side jet propulsion unit 16A is relatively conventional, and thus, the detailed configuration of the left side jet propulsion unit 16A will be omitted for the sake of brevity.

Figure 7:
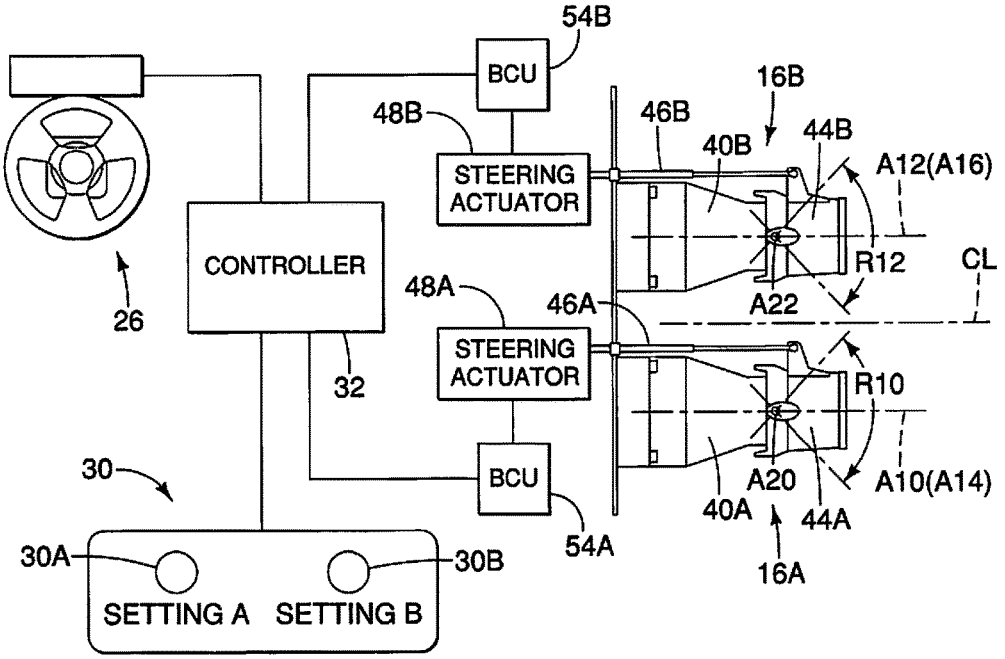
FIG. 7 is a schematic diagram of an electric control system for operating the steering nozzles, illustrating the boat is operated in a straight thrust mode.

As illustrated in FIGS. 5 to 9, the steering nozzle 44A is pivotally coupled to a housing of the jet pump 40A. The steering nozzle 44A is movable with respect to the hull 12 within a movable range R10 about a steering axis A20. The steering nozzle 44A moves in response to the steering operation of the steering 26. The steering axis A20 extends in a vertical direction of the boat 10 that is perpendicular to the widthwise direction W and the lengthwise direction L of the boat 10. Thus, the steering nozzle 44A pivots leftward and rightward relative to the hull 12 within the movable range R10. The steering nozzle 44A has a propulsion axis A14 (e.g., a first propulsion axis) along which the left side jet propulsion unit 16A generates the propulsion force F12. The propulsion axis A14 generally extends along a center axis of the steering nozzle 44A. Thus, the steering nozzle 44A changes the direction of the propulsion force F12 by pivoting within the movable range R10. As illustrated in FIG. 7, in the illustrated embodiment, the movable range R10 is 45 degrees from a predetermined reference axis A10 to one end and 45 degrees from the predetermined reference axis A10 to the other end (90 degrees in total). In the illustrated embodiment, the predetermined reference axis A10 extends parallel to the longitudinal center axis CL and extends through the steering axis A20. Of course, the movable range R10 can have a different range if needed and/or desired depending on the particular design of the boat 10. Also, the steering nozzle 44A can be a different type of deflector that changes the direction of the water jet generated by the jet pump 40A, as needed and/or desired.

As illustrated in FIGS. 4 to 9, the right side jet propulsion unit 16B generally includes a jet pump 40B, an engine 428, a steering deflector or nozzle 44B (e.g., a second steering deflector), a steering link 46B, a steering actuator 48B. The right side jet propulsion unit 16B also includes a reversing bucket (not shown) or any other conventional parts, which are not shown in the drawings for the sake of brevity. In the illustrated embodiment, the right side jet propulsion unit 16B is identical to the left side jet propulsion unit 16A, and thus, the detailed description of the right side jet propulsion unit 16B will be omitted for the sake of brevity.

Also, as illustrated in FIGS. 5 to 9, the steering nozzle 44B is pivotally coupled to a housing of the jet pump 40B. The steering nozzle 44B is movable with respect to the hull 12 within a movable range RI 2 about a steering axis A22. The steering nozzle 44B moves in response to the steering operation of the steering 26. The steering axis A22 extends in the vertical direction of the boat 10 that is perpendicular to the widthwise direction W and the lengthwise direction L of the boat 10. Thus, the steering nozzle 44B pivots leftward and rightward relative to the hull 12 within the movable range R12. The steering nozzle 44B has a propulsion axis A16 (e.g., a second propulsion axis) along which the right side jet propulsion unit 16B generates the propulsion force F14. The propulsion axis A16 generally extends along a center axis of the steering nozzle 44B. Thus, the steering nozzle 44B changes the direction of the propulsion force F14 by pivoting within the movable range R12. As illustrated in FIG. 7, in the illustrated embodiment, the movable range R12 is 45 degrees from a predetermined reference axis A12 to one end and 45 degrees from the predetermined reference axis A12 to the other end (90 degrees in total). In the illustrated embodiment, the predetermined reference axis A12 extends parallel to the longitudinal center axis CL and extends through the steering axis A22. Of course, the movable range R12 can have a different range if needed and/or desired depending on the particular design of the boat 10. Also, the steering nozzle 44B can be a different type of deflector that changes the direction of the water jet generated by the jet pump 40B, as needed and/or desired.

Referring further to FIG. 4, the jet propulsion units 16A and 16B are electrically connected to the controller 32. Specifically, the left side jet propulsion unit 16A further has an ECU (Electric Control Unit) 50A, a revolution sensor 52A and a BCU (Boat Control Unit) 54A. The ECU 50A is electrically connected to the controller 32, and controls the engine 42A based on control signal received from the controller 32. The ECU 50A also sends control results of the engine 42A and detection results of the revolution sensor 52A to the controller 32. The revolution sensor 52A includes a crank sensor to monitor the rotational speed (e.g., engine rotational speed) of a crankshaft of the engine 42A, for example. The revolution sensor 52A sends the detection result to the ECU 50A. Of course, the revolution sensor 52A is not limited to this sensor, and can be different type of sensors to monitor the rotational speed of the engine 42A. The BCU 54A is electrically connected between the controller 32 and the steering actuator 48A, and controls or drives the steering actuator 48A based on control signal received from the controller 32.

Similarly, the right side jet propulsion unit 16B further has an ECU 50B, a revolution sensor 52B and a BCU 54B. The right side jet propulsion unit 16B has the same configuration as the left side jet propulsion unit 16A, and thus, the detailed description of the right side jet propulsion unit 16B will be omitted for the sake of brevity. In the illustrated embodiment, as illustrated in FIG. 4, the BCU 54A is electrically connected between the controller 32 and the steering actuator 48A. However, the BCU 54A can alternatively be provided as part of the controller 32. Also, the BCU 54A can be electrically connected between the ECU 50A and the steering actuator 48A. Also, similarly, the BCU 54B can alternatively be provided as part of the controller 32. Furthermore, the BCU 54B can be electrically connected between the ECU 50B and the steering actuator 48B. In the illustrated embodiment, for the sake of brevity, the controller 32 operating the steering actuators 48A and 48B refers to the controller 32 sending the control signals to the ECU 50A and 50B to operate the steering actuators 48A and 48B. The ECU 50A and 50B, and the BCU 54A and 54B can include a microcomputer or processor, respectively.

With this configuration, the controller 32 is programmed to control the jet propulsion units 16A and 16B to independently generate the propulsion forces F12 and F14 of the jet propulsion units 16A and 16B, respectively, and to independently steer or turn the jet propulsion units 16A and 16B about the steering axes A20 and A22, respectively, in order to propel the boat 10. Thus, in the illustrated embodiment, the controller 32 is electrically coupled to the jet propulsion units 16A and 16B to operate the steering nozzles 44A and 44B. Also, in the illustrated embodiment, as mentioned above, the control switch 30 is operated by the user to set an operation mode of the jet propulsion units 16A and 16B for generating desired boat's wake WK from among a plurality of selectable operation modes.

In the illustrated embodiment, the selectable operation modes include a "straight thrust mode" (FIG. 7) and an "inclined thrust mode" (FIGS. 5, 6, 8 and 9). Thus, in the illustrated embodiment, the control switch 30 is configured to switch an operation mode of the jet propulsion units 16A and 16B between the straight thrust mode and the inclined thrust mode. As illustrated in FIG. 7, the straight thrust mode is a default or normal operation mode of the jet propulsion units 16A and 16B. The straight thrust mode is selected when none of the buttons 30A and 30B of the control switch 30 is operated. The controller 32 determines that the straight thrust mode is selected when the operation signal of the control switch 30 is not received. Of course, the control switch 30 can be configured to output an operation signal indicating that none of the buttons 30A and 30B is operated. In this case, the controller 32 can determine that the straight thrust mode is selected based on the operation signal. FIG. 7 illustrates the non-steered or neutral positions of the steering nozzles 44A and 44B of the jet propulsion units 16A and 16B in the straight thrust mode. In the illustrated embodiment, as illustrated in FIG. 7, the propulsion axes A14 and A16 of the jet propulsion units 16A and 16B are aligned with the predetermined reference axes A10 and A12, respectively, while the steering 26 is in the straight steering position (i.e., while the steering nozzles 44A and 44B are positioned in the non-steered or neutral positions). Also, as mentioned above, in the illustrated embodiment, the predetermined reference axes A10 and A12 extend parallel to the longitudinal center axis CL. Thus, in the illustrated embodiment, the propulsion axes A14 and A16 are oriented parallel to the longitudinal center axis CL while the steering 26 is in the straight steering position. While the straight thrust mode is selected, the steering nozzles 44A and 44B are steered in the same direction by the same angle relative to the predetermined reference axes A10 and A12 according to the steering operation of the steering 26. Specifically, the steering nozzles 44A and 44B are turned within the movable ranges R10 and R12 using the predetermined reference axes A10 and A12 as the steering centers of the movable ranges R10 and R12.

Figure 8:
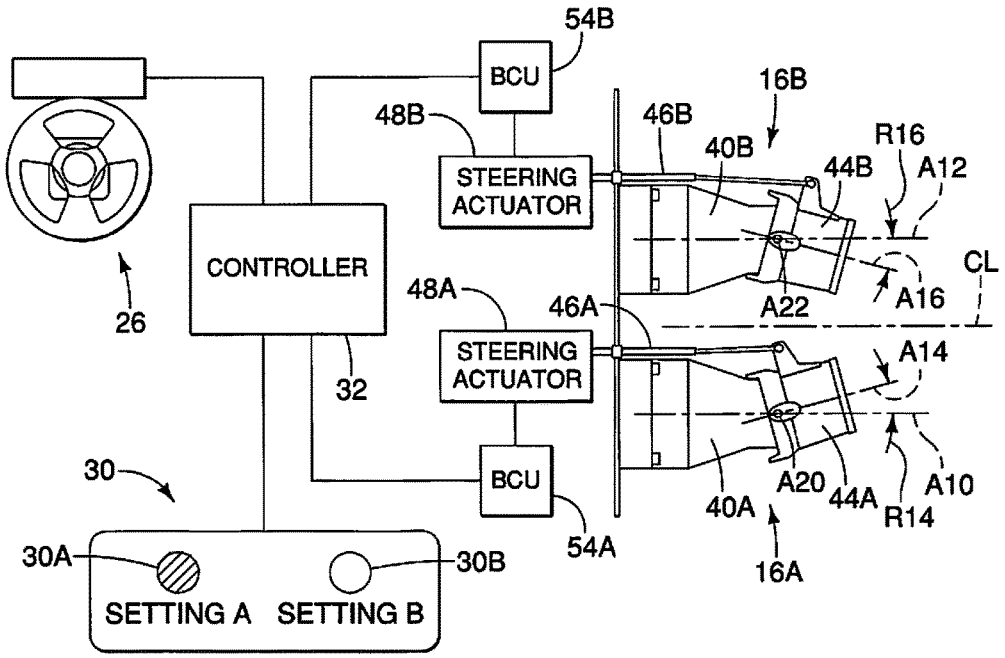
FIG. 8 is a schematic diagram of the electric control system illustrated in FIG. 7, illustrating the boat is operated in the toe-in thrust mode.
Figure 9:
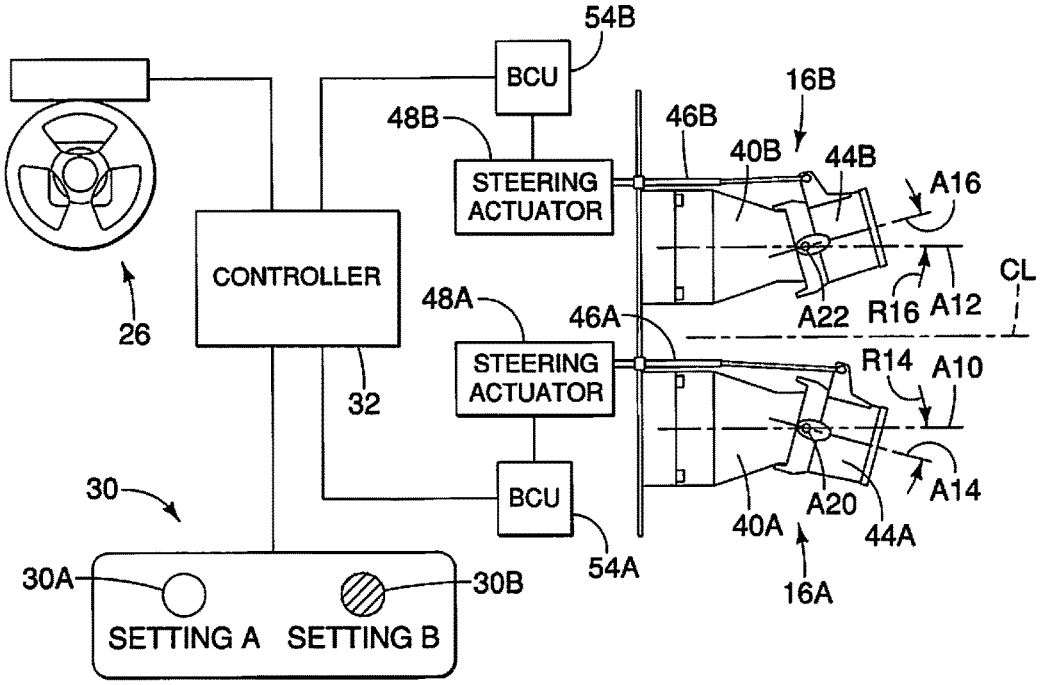
FIG. 9 is a schematic diagram of the electric control system illustrated in FIG. 7, illustrating the boat is operated in the toe-out thrust mode.

As illustrated in FIGS. 5, 6, 8 and 9, the inclined thrust mode is an operation mode in which the jet propulsion units 16A and 16B are oriented such that the propulsion axes A14 and A16 are non-parallel to the longitudinal center axis CL of the hull 12 while the steering 26 is in the straight steering position. More specifically, in the inclined thrust mode, the jet propulsion units 16A and 16B are oriented such that the propulsion axes A14 and A16 are laterally and oppositely inclined with respect to the longitudinal center axis CL while the steering 26 is in the straight steering position. In the illustrated embodiment, the inclined thrust mode includes the "toe-in thrust mode" (FIGS. 5 and 8) and the "toe-out thrust mode" (FIGS. 6 and 9). Thus, in the illustrated embodiment, the control switch 30 is configured to switch the inclined thrust mode of the jet propulsion units 16A and 16B between the toe-in thrust mode and the toe-out thrust mode.

FIGS. 5 and 8 illustrate the non-steered or neutral positions of the steering nozzles 44A and 44B of the jet propulsion units 16A and 16B in the toe-in thrust mode. In the illustrated embodiment, as illustrated in FIGS. 5 and 8, the toe-in thrust mode is an operation mode in which the propulsion axes A14 and A16 converge as the propulsion axes A14 and A16 extend rearwardly from the steering nozzles 44A and 44B while the steering 26 is in the straight steering position.

The toe-in thrust mode is selected when the button 30A corresponding to the toe-in thrust mode is operated. The controller 32 determines that the toe-in thrust mode is selected when the operation signal of the control switch 30 indicative of the operation of the button 30A is received. In the illustrated embodiment, as illustrated in FIGS. 5 and 8, the propulsion axes A14 and A16 of the jet propulsion units 16A and 16B are angularly offset relative to the predetermined reference axes A10 and A12, respectively, while the steering 26 is in the straight steering position. Specifically, when the button 30A is operated while the steering 26 is in the straight steering position, the controller 32 operates the steering actuators 48A and 48B to turn the steering nozzles 44A and 44B to the non-steered or neutral positions, respectively, as shown in FIGS. 5 and 8. Specifically, when the button 30A is operated to switch from the straight thrust mode to the toe-in thrust mode, the controller 32 operates the steering actuator 48A to turn the steering nozzle 44A of the left side jet propulsion unit 16A in the counterclockwise direction by an offset angle R14. In particular, as illustrated in FIG. 8, the steering actuator 48A pulls or shortens the steering link 46A to turn the steering nozzle 44A in the counterclockwise direction. The offset angle R14 is an angle defined between the propulsion axis A14 at the non-steered or neutral position and the predetermined reference axis A10. Also, the controller 32 operates the steering actuator 48B to turn the steering nozzle 44B of the right side jet propulsion unit 16B in the clockwise direction by an offset angle R16. In particular, as illustrated in FIG. 8, the steering actuator 48B pushes or extends the steering link 46B to turn the steering nozzle 44B in the clockwise direction. The offset angle R16 is an angle defined between the propulsion axis A16 at the non-steered or neutral position and the predetermined reference axis A12. In the illustrated embodiment, the offset angles R14 and R16 are equal to each other, and are set to an angle between 7 and 8 degrees, for example. However, the offset angles R14 and R16 can be a different value. For example, the offset angles R14 and R16 can be an angle that is more than or equal to 5 degrees and less than or equal to 30 degrees, for example.

In the illustrated embodiment, the steering actuators 48A and 48B move the steering nozzles 44A and 44B to the non-steered or neutral positions independently from the steering operation of the steering 26 in response to the user operation of the button 30A. In other words, when the button 30A is operated, the steering actuators 48A and 48B move the steering nozzles 44A and 44B to the non-steered or neutral positions without the steering operation of the steering 26.

In the illustrated embodiment, while the toe-in thrust mode is selected, the steering nozzles 44A and 44B are steered in the same direction by the same angle according to the steering operation of the steering 26. Specifically, the steering nozzles 44A and 44B are steered within the movable ranges R10 and R12 of the steering nozzles 44A and 44B (FIG. 7) to steer the boat 10 using the non-steered or neutral positions shown FIGS. 5 and 8 as the steering centers, respectively. Of course, alternatively, the steering nozzles 44A and 44B can be steered in the same direction by different angles depending on the current angles of steering nozzles 44A and 44B.

With the above-mentioned configuration, as illustrated in FIG. 5, the jet propulsion units 16A and 16B generate the propulsion forces F12 and F14 along the propulsion axes A14 and A16, respectively. In the illustrated embodiment, the offset angles R14 and R16 are equal to each other. Thus, the resultant force of the propulsion forces F12 and F14 propels the boat 10 straight when the propulsion forces F12 and F14 have the same magnitude. Also, in this case, the water jets ejected from the steering nozzles 44A and 44B converge behind the boat 10, which creates the boat's wake WK that is relatively higher in the height and shorter in the length, for example. Thus, the boat's wake WK that is suitable for the wakesurfing (FIG. 3) can be created, for example. Therefore, the toe-in thrust mode can also be called a wakesurfing mode. However, of course, the rider RD can also enjoy the wakeboarding or other surface water sports with this boat's wake WK that is created in the toe-in thrust mode.

FIGS. 6 and 9 illustrate the non-steered or neutral positions of the steering nozzles 44A and 44B of the jet propulsion units 16A and 16B in the toe-out thrust mode. In the illustrated embodiment, as illustrated in FIGS. 6 and 9, the toe-out thrust mode is an operation mode in which the propulsion axes A14 and A16 diverge as the propulsion axes A14 and A16 extend rearwardly from the steering nozzles 44A and 44B while the steering 26 is in the straight steering position.

The toe-out thrust mode is selected when the button 30B corresponding to the toe-out thrust mode is operated. The controller 32 determines that the toe-out thrust mode is selected when the operation signal of the control switch 30 indicative of the operation of the button 30B is received. In the illustrated embodiment, as illustrated in FIGS. 6 and 9, the propulsion axes A14 and A16 of the jet propulsion units 16A and 16B are angularly offset relative to the predetermined reference axes A10 and A12, respectively, while the steering 26 is in the straight steering position. Specifically, when the button 30B is operated while the steering 26 is in the straight steering position, the controller 32 operates the steering actuators 48A and 48B to turn the steering nozzles 44A and 44B to the non-steered or neutral positions, respectively, as shown in FIGS. 6 and 9. Specifically, when the button 30B is operated to switch from the straight thrust mode to the toe-out thrust mode, the controller 32 operates the steering actuator 48A to turn the steering nozzle 44A of the left side jet propulsion unit 16A in the clockwise direction by the offset angle R14. In particular, as illustrated in FIG. 9, the steering actuator 48A pushes or extends the steering link 46A to turn the steering nozzle 44A in the clockwise direction. Also, the controller 32 operates the steering actuator 48B to turn the steering nozzle 44B of the right side jet propulsion unit 16B in the counterclockwise direction by the offset angle R16. In particular, as illustrated in FIG. 9, the steering actuator 48B pulls or shortens the steering link 46B to turn the steering nozzle 44B in the counterclockwise direction. In the illustrated embodiment, the offset angles R14 and R16 are equal to each other, and are set to an angle between 7 and 8 degrees, for example. However, the offset angles R14 and R16 can be a different value. For example, the offset angles R14 and R16 can be an angle that is more than or equal to 5 degrees and less than or equal to 30 degrees, for example. In the illustrated embodiment, the offset angles R14 and R16 in the toe-out thrust mode (FIG. 9) are equal to the offset angles R14 and R16 in the toe-in thrust mode (FIG. 8). However, the offset angles R14 and R16 in the toe-out thrust mode (FIG. 9) can be different from the offset angles R14 and R16 in the toe-in thrust mode (FIG. 8).

In the illustrated embodiment, the steering actuators 48A and 48B move the steering nozzles 44A and 44B to the non-steered or neutral positions independently from the steering operation of the steering 26 in response to the user operation of the button 30B. In other words, when the button 30B is operated, the steering actuators 48A and 48B move the steering nozzles 44A and 44B to the non-steered or neutral positions without the steering operation of the steering 26.

In the illustrated embodiment, while the toe-out thrust mode is selected, the steering nozzles 44A and 44B are steered in the same direction by the same angle according to the steering operation of the steering 26. Specifically, the steering nozzles 44A and 44B are steered within the movable ranges R10 and R12 of the steering nozzles 44A and 44B (FIG. 7) to steer the boat 10 using the non-steered or neutral positions shown FIGS. 6 and 9 as the steering centers, respectively. Of course, alternatively, the steering nozzles 44A and 44B can be steered in the same direction by different angles depending on the current angles of steering nozzles 44A and 44B.

With the above-mentioned configuration, as illustrated in FIG. 6, the jet propulsion units 16A and 16B generate the propulsion forces F12 and F14 along the propulsion axes A14 and A16, respectively. In the illustrated embodiment, the offset angles R14 and R16 are equal to each other. Thus, the resultant force of the propulsion forces F2 and F14 propels the boat 10 straight when the propulsion forces F12 and F14 have the same magnitude. Also, in this case, the water jets ejected from the steering nozzles 44A and 44B diverge behind the boat 10, which creates the boat's wake WK that is relatively shorter in the height and longer in the length, for example. Thus, the boat's wake WK that is suitable for the wakeboarding (FIG. 2) can be created, for example. Therefore, the toe-out thrust mode can also be called a wakeboarding mode. However, of course, the rider RD can also enjoy wakesurfing or other surface water sports with this boat's wake WK that is created in the toe-out thrust mode.

In the illustrated embodiment, the operation mode of the jet propulsion units 16A and 16B are switchable between the straight thrust mode, the toe-in thrust mode, and the toe-out thrust mode. However, the present disclosure is not limited to this configuration. The operation mode of the jet propulsion units 16A and 16B can only be switchable between the straight thrust mode and the toe-in thrust mode, or between the straight thrust mode and the toe-out thrust mode.

In the illustrated embodiment, the predetermined reference axes A10 and A12 extend parallel to the longitudinal center axis CL. However, the predetermined reference axes A10 and A12 can be non-parallel to the longitudinal center axis CL. For example, the predetermined reference axes A10 and A12 can be oriented such that the predetermined reference axes A10 and A12 converge as the predetermined reference axes A10 and A12 extend rearwardly from the steering nozzles 44A and 44B, respectively. Also, for example, the predetermined reference axes A10 and A12 can be oriented such that the predetermined reference axes A10 and A12 diverge as the predetermined reference axes A10 and A12 extend rearwardly from the steering nozzles 44A and 44B, respectively. In these cases, the operation mode of the jet propulsion units 16A and 16B does not need to be switchable, and can only include the straight thrust mode in which the propulsion axes A14 and A16 are aligned with the predetermined reference axes A10 and A12 while the steering 26 is in the straight steering position.

In the illustrated embodiment, the toe-in thrust mode can also be configured to have a plurality of toe-in thrust modes with different offset angles R14 and R16. For example, the toe-in thrust mode can have a first toe-in thrust mode in which the offset angles R14 and R16 are set to 7 degrees, and a second toe-in thrust mode in which the offset angles R14 and R16 are set to 20 degrees. Specifically, when the operation mode of the jet propulsion units 16A and 16B is only switchable between the straight thrust mode and the toe-in thrust mode, as mentioned above, the first toe-in thrust mode is assigned to the "setting A" and the second toe-in thrust mode is assigned to the "setting B," for example. In this case, the first toe-in thrust mode can be selected when the button 30A for the setting A is operated. Also, the second toe-in thrust mode can be selected when the button 30B for the setting B is operated. With this configuration, the rider RD can enjoy different boat's wakes WK with different height and length. Similarly, the toe-out thrust mode can also be configured to have a plurality of toe-out thrust modes with different offset angles R14 and R16. For example, the toe-out thrust mode can have a first toe-out thrust mode in which the offset angles R14 and R16 are set to 7 degrees, and a second toe-out thrust mode in which the offset angles R14 and R16 are set to 20 degrees. Specifically, when the operation mode of the jet propulsion units 16A and 16B is only switchable between the straight thrust mode and the toe-out thrust mode, as mentioned above, the first toe-out thrust mode is assigned to the "setting A" and the second toe-out thrust mode is assigned to the "setting B," for example. In this case, the first toe-out thrust mode can be selected when the button 30A for the setting A is operated. Also, the second toe-out thrust mode can be selected when the button 30B for the setting B is operated. Therefore, in the illustrated embodiment, the control switch 30 switches the inclined thrust mode of the jet propulsion units 16A and 16B between the first and second toe-in thrust modes (the first and second toe-out thrust modes) (e.g., different inclined thrust modes) with different offset angles R14 and R16.

In the illustrated embodiment, the controller 32 changes the operation mode of the jet propulsion units 16A and 16B in response to detecting the user operation of the buttons 30A and 30B of the control switch 30. However, in the illustrated embodiment, as illustrated in FIGS. 10 and 11, the controller 32 can be configured to change the operation mode of the jet propulsion units 16A and 16B only when predetermined conditions are satisfied.

Figure 10:
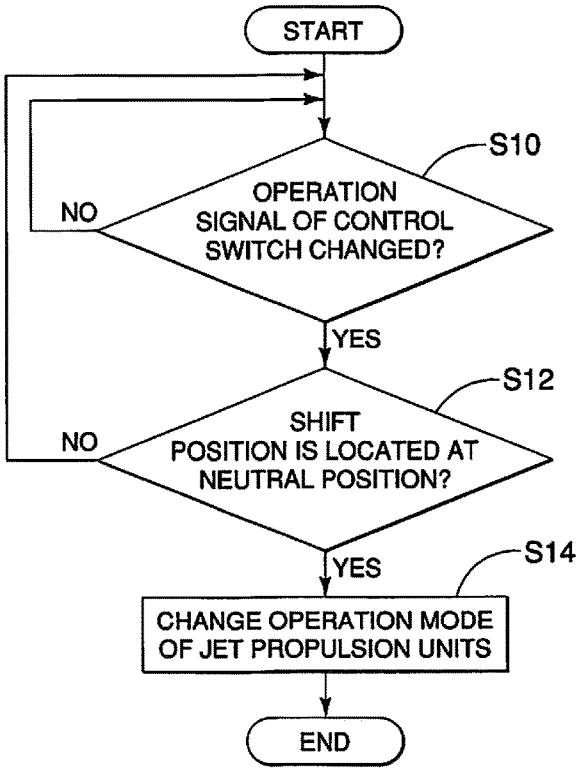
FIG. 10 is a flowchart of a processing for changing an operation mode of the jet propulsion units in accordance with a modification example of the first embodiment.

For example, as illustrated in FIG. 10, the controller 32 can be configured to change the operation mode of the jet propulsion units 16A and 16B and operate the steering nozzles 44A and 44B upon satisfying following conditions: detecting that the user operation (e.g., the user input) specifies the change in the operation mode of the jet propulsion units 16A and 16B, and detecting that the shift position of the boat 10 is located at the neutral position. More specifically, the controller 32 periodically monitors whether the operation signal of the control switch 30 is changed. The controller 32 determines whether the user operation specifies the change in the operation mode of the jet propulsion units 16A and 16B based on the operation signal of the control switch 30 (step S10). If the operation signal of the control switch 30 indicates the operation of the button 30A or 30B or the reset of the button 30A or 30B (YES in step S10), then the controller 32 further determines whether the shift position of the boat 10 is located at the neutral position based on the operation signal of the remote control 28 (step S12). If the operation signal of the remote control 28 indicates that the shift position of the boat 10 is located at the neutral position (YES in step S12), then the controller 32 changes the operation mode of the jet propulsion units 16A and 16B (step S14). Specifically, the controller 32 operates the steering actuators 48A and 48B to turn the steering nozzles 44A and 44B to the non-steered or neutral positions shown in FIGS. 7 to 9. On the other hand, if the operation signal of the control switch 30 does not indicate the operation of the button 30A or 30B or reset of the button 30A or 30B (NO in step S10), or if the operation signal of the remote control 28 does not indicate that the shift position of the boat 10 is located at the neutral position (i.e., the shift position is located in the forward or reveres position) (NO in step S12), then the controller 32 does not change the operation mode of the jet propulsion units 16A and 16B, and the process goes back to step S10. In this example, optionally, when the determination result in step S12 is negative (NO in step S12), then the controller 32 can display a message on a display (not shown) to prompt the user or operator to set the shift position of the boat 10 at the neutral position.

Figure 11:
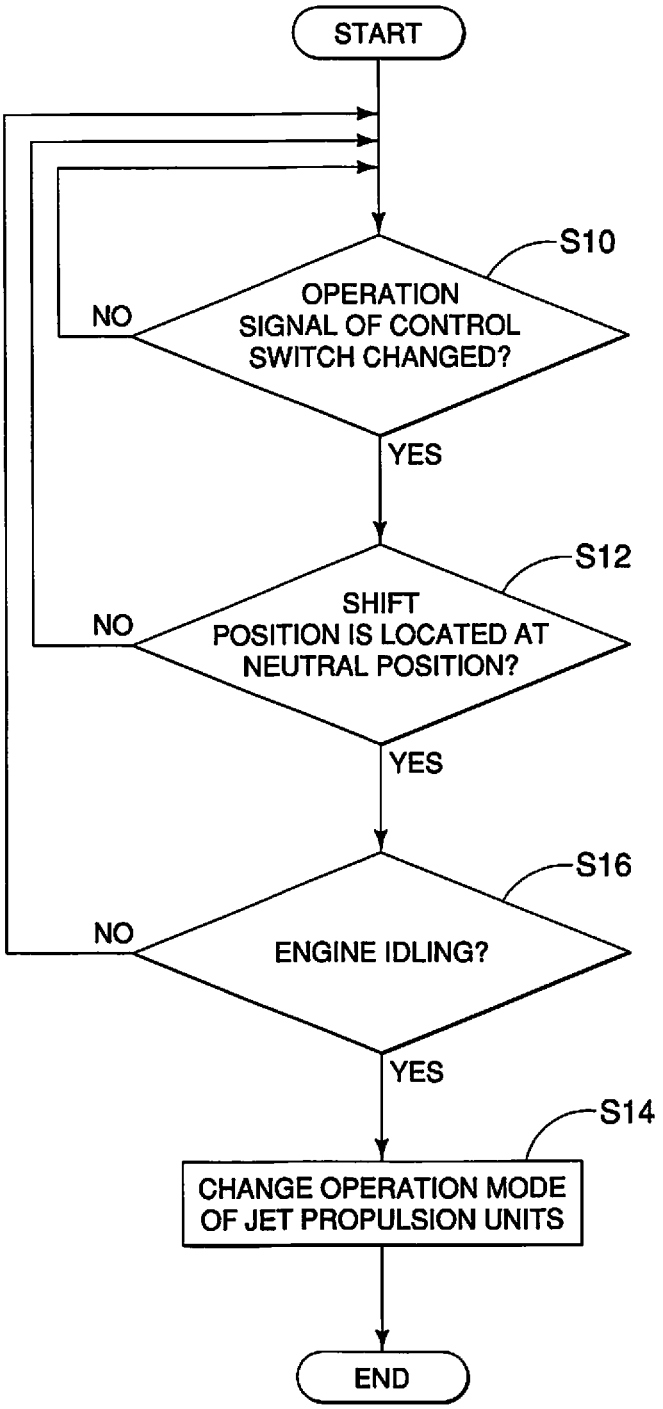
FIG. 11 is a flowchart of a processing for changing an operation mode of the jet propulsion units in accordance with another modification example of the first embodiment.

Alternatively, as illustrated in FIG. 11, the controller 32 can also be configured to change the operation mode of the jet propulsion units 16A and 16B and operate the steering nozzles 44A and 44B upon satisfying following conditions: detecting that the user operation (e.g., the user input) specifies the change in the operation mode of the jet propulsion units 16A and 16B, detecting that the shift position of the boat 10 is located at the neutral position, and detecting that the rotational speed of the engines 42A and 42B falls within a predetermined range. In other words, the processing illustrated in FIG. 11 is basically identical to the processing illustrated in FIG. 10, except that the controller 32 further determines whether the engines 42A and 42B are in the idling state (step S16). Specifically, the controller 32 executes the above-mentioned steps S10 and S12. If the operation signal of the remote control 28 indicates that the shift position of the boat 10 is located at the neutral position (YES in step S12), then the controller 32 further determines whether the engines 42A and 42B are in the idling state (step S16). Specifically, the controller 32 determines whether the rotational speed of the engines 42A and 42B falls within the predetermined range based on the detection results of the revolution sensors 52A and 52B. The predetermined range is preset and is indicative of the rotational speed range of the engines 42A and 42B at the idling state. In the illustrated embodiment, the predetermined range is set to a range between 1200 rpm and 1600 rpm. If the controller 32 determines that the rotational speed of the engines 42A and 42B falls within the predetermined range (Yes in step S16), then the controller 32 changes the operation mode of the jet propulsion units 16A and 16B (step S14). On the other hand, if the operation signal of the control switch 30 does not indicate the operation of the button 30A or 30B or the reset of the button 30A or 30B (NO in step S10), if the operation signal of the remote control 28 does not indicate that the shift position of the boat 10 is located at the neutral position (i.e., the shift position is located in the forward or reveres position) (NO in step S12), or if the rotational speed of the engines 42A and 42B does not fall within the predetermined range (NO in step S16), then the controller 32 does not change the operation mode of the jet propulsion units 16A and 16B, and the process goes back to step S10. In this example, optionally, when the determination result in step S12 is negative (NO in step S12), then the controller 32 can display a message on a display (not shown) to prompt the user or operator to set the shift position of the boat 10 at the neutral position. Furthermore, optionally, when the determination result in step S16 is negative (NO in step S6), then the controller 32 can display a message on a display (not shown) to prompt the user or operator to set the rotational speed of the engines 42A and 42B within the predetermined range.

Second Embodiment

Referring now to FIGS. 12 to 16, a boat 100 (FIG. 1) in accordance with a second embodiment will now be explained. The boat 100 basically has the same configuration as the boat 10 in accordance with the first embodiment, except for a mechanical connection between a mechanical steering 126 and jet propulsion units 116A and 116B, and a mechanical connection between a mechanical control switch 130 and the jet propulsion units 116A and 116B. In view of the similarity between the first and second embodiments, the descriptions of the parts of the second embodiment that are identical to the parts of the first embodiment may be omitted for the sake of brevity.

Figure 12:
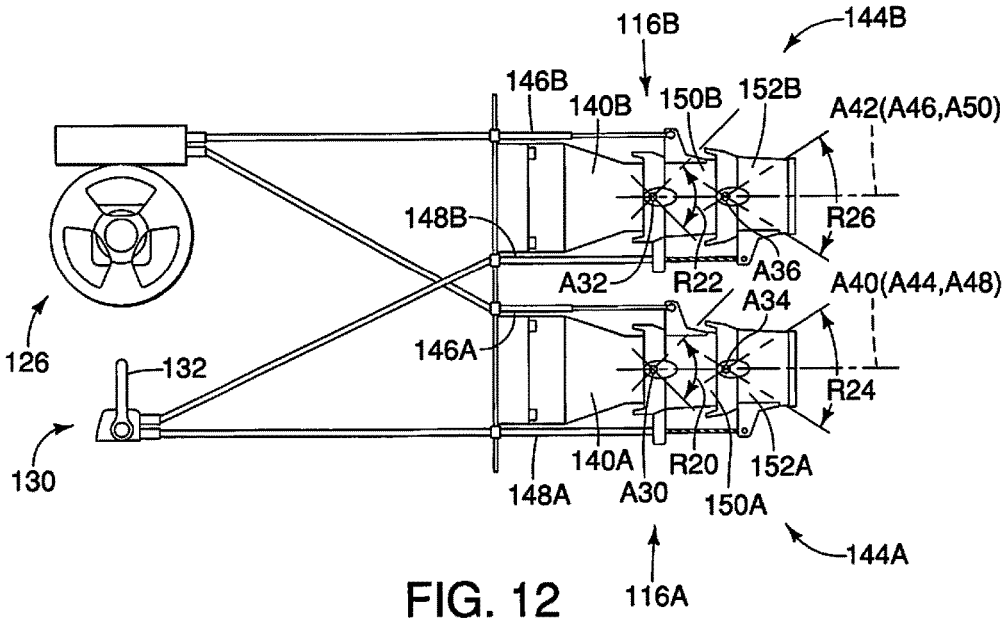
FIG. 12 is a schematic diagram of a mechanical control system for operating steering nozzles in accordance with a second embodiment, illustrating a boat is operated in the straight thrust mode.
Figure 13:
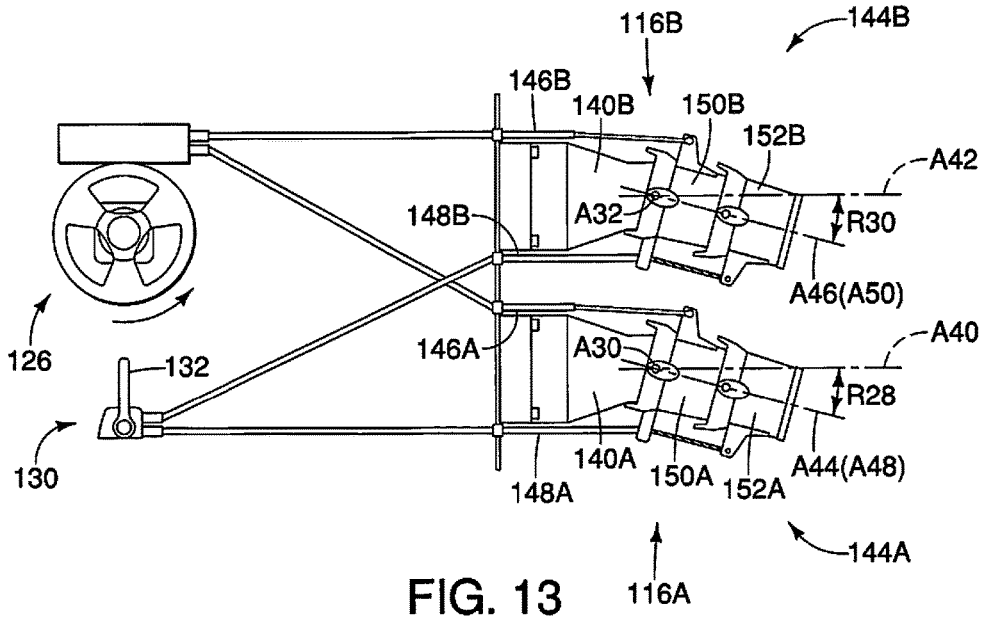
FIG. 13 is a schematic diagram of the mechanical control system illustrated in FIG. 12, illustrating the boat is steered to the left while the boat is operated in the straight thrust mode.
Figure 14:
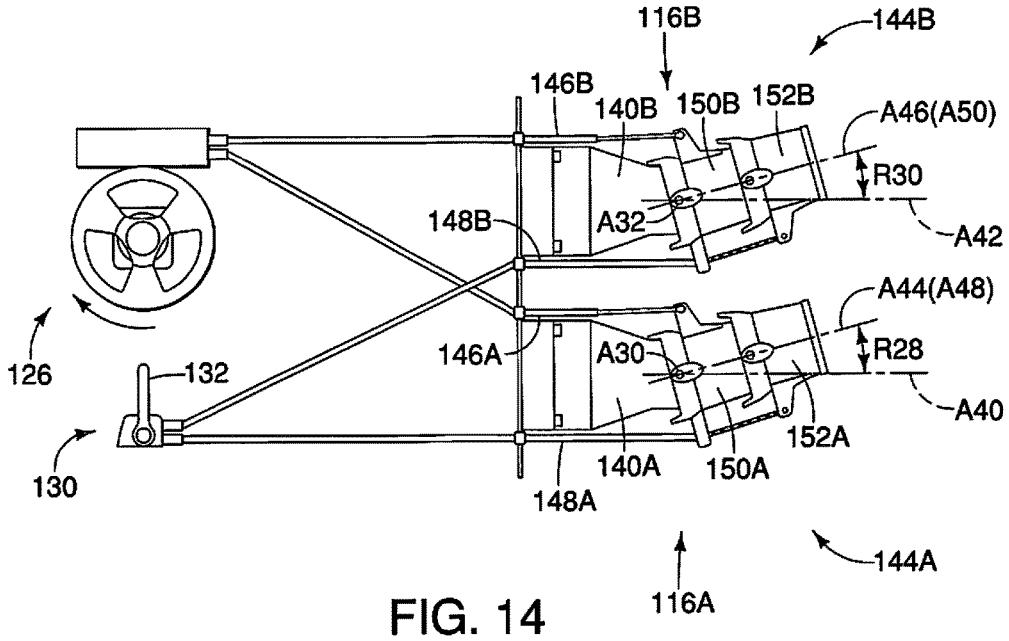
FIG. 14 is a schematic diagram of the mechanical control system illustrated in FIG. 12, illustrating the boat is steered to the right while the boat is operated in the straight thrust mode.
Figure 15:
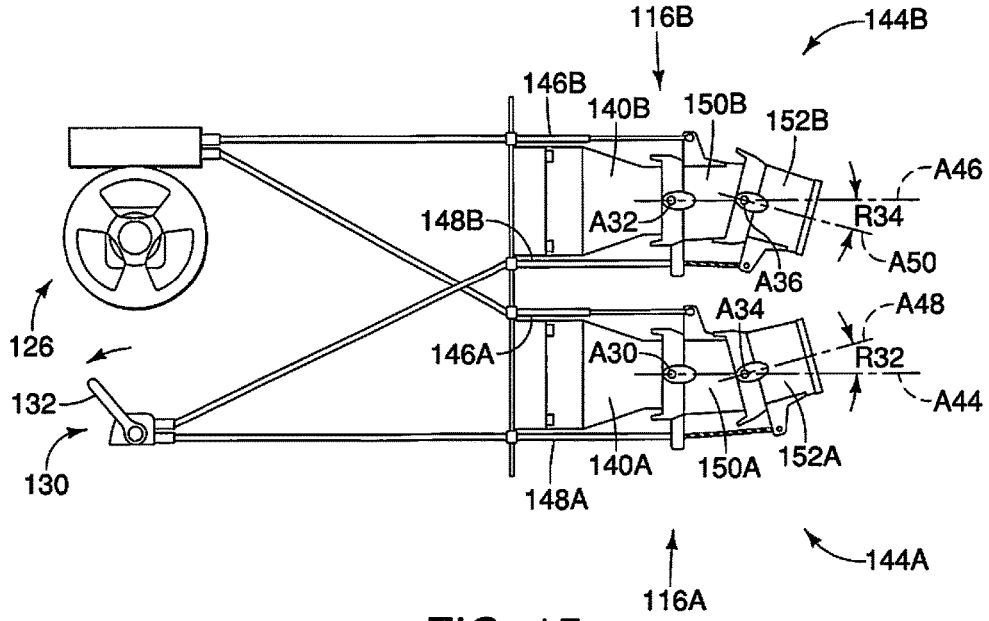
FIG. 15 is a schematic diagram of the mechanical control system illustrated in FIG. 12, illustrating the boat is operated in the toe-in thrust mode.
Figure 16:
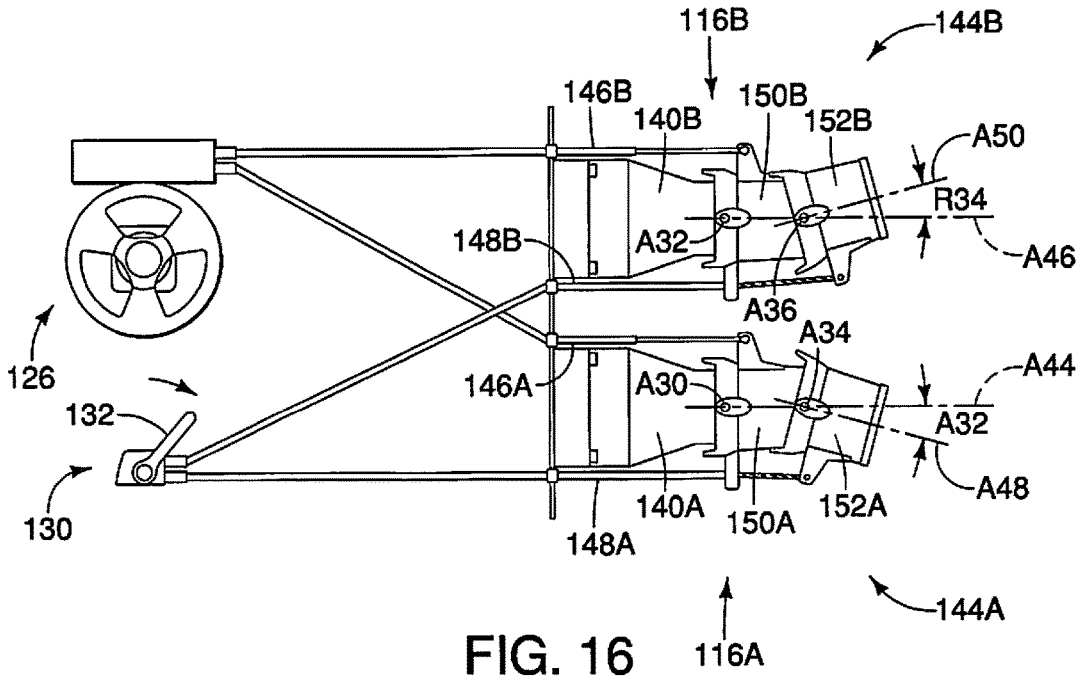
FIG. 16 is a schematic diagram of the mechanical control system illustrated in FIG. 12, illustrating the boat is operated in the toe-out thrust mode.

In the illustrated embodiment, the control switch 130 is operated by the user to set an operation mode of the jet propulsion units 116A and 116B for generating desired boat's wake WK from among a plurality of selectable operation modes. Similar to the boat 10 in accordance with the first embodiment, the selectable operation modes include a "straight thrust mode" (FIGS. 12 to 14), and an "inclined thrust mode" (FIGS. 15 and 16). Also, in the illustrated embodiment, the inclined thrust mode includes the "toe-in thrust mode" (FIG. 15) and the "toe-out thrust mode" (FIG. 16). These operation modes of the jet propulsion units 116A and 116B are the same as the operation modes of the jet propulsion units 16A and 16B in accordance with the first embodiment, and thus, the detailed description will be omitted for the sake of brevity. In the illustrated embodiment, as illustrated in FIGS. 12 to 14, while a lever 132 of the control switch 130 is positioned in a neutral or non-operated position, the straight thrust mode of the jet propulsion units 116A and 116B is selected. Also, as illustrated in FIG. 15, while the lever 132 is positioned in a toe-in thrust mode position, the toe-in thrust mode is selected. Furthermore, as illustrated in FIG. 16, while the lever 132 is positioned in a toe-out thrust mode position, the toe-out thrust mode is selected.

As illustrated in FIG. 12, the left side jet propulsion unit 116A generally includes a jet pump 140A, an engine (not shown), a steering deflector 144A, a steering link 146A, and a deflector link 148A. The left side jet propulsion unit 116A also include a reversing bucket (not shown) or any other conventional parts, which are not shown in the drawings for the sake of brevity. In the illustrated embodiment, the steering deflector 144A is pivotally coupled to a housing of the jet pump 140A. Specifically, in the illustrated embodiment, the steering deflector 144A includes a base nozzle 150A and an end nozzle 152A. The base nozzle 150A is pivotally coupled to the housing of the jet pump 140A. Specifically, the base nozzle 150A pivots relative to the housing of the jet pump 140A within a movable range R20 about a pivot axis A30 in response to the steering operation of the steering 126. Furthermore, the end nozzle 152A is pivotally coupled to the base nozzle 150A. Specifically, the end nozzle 152A pivots relative to the base nozzle 150A within a movable range R24 about the pivot axis A34 in response to the switching operation of the control switch 130. The pivot axis A34 is located spaced apart from the pivot axis A30 in a direction parallel to a longitudinal center axis CL of the boat 100. The steering link 146A is mechanically connected between the steering 126 and the base nozzle 150A. In the illustrated embodiment, the steering link 146A includes a cable or wire (e.g., a Bowden cable). The deflector link 148A is mechanically connected between the control switch 130 and the end nozzle 152A. In the illustrated embodiment, the deflector link 148A includes a cable or wire (e.g., a Bowden cable).

Similarly, as illustrated in FIG. 12, the right side jet propulsion unit 116B generally includes a jet pump 140B, an engine (not shown), a steering deflector 144B, a steering link 146B, and a deflector link 148B. The right side jet propulsion unit 116B also include a reversing bucket (not shown) or any other conventional parts, which are not shown in the drawings for the sake of brevity. In the illustrated embodiment, the steering deflector 144B is pivotally coupled to a housing of the jet pump 140B. Specifically, in the illustrated embodiment, the steering deflector 144B includes a base nozzle 150B and an end nozzle 152B. The base nozzle 150B is pivotally coupled to the housing of the jet pump 140B. Specifically, the base nozzle 150B pivots relative to the housing of the jet pump 140B within a movable range R22 about a pivot axis A32 in response to the steering operation of the steering 126. Furthermore, the end nozzle 152B is pivotally coupled to the base nozzle 150B. Specifically, the end nozzle 152B pivots relative to the base nozzle 150B within a movable range R26 about the pivot axis A36 in response to the switching operation of the control switch 130. The pivot axis A36 is located spaced apart from the pivot axis A32 in a direction parallel to the longitudinal center axis CL of the boat 100. The steering link 146B is mechanically connected between the steering 126 and the base nozzle 150B. In the illustrated embodiment, the steering link 146B includes a cable or wire (e.g., a Bowden cable). The deflector link 148B is mechanically connected between the control switch 130 and the end nozzle 152B. In the illustrated embodiment, the deflector link 148B includes a cable or wire (e.g., a Bowden cable).

In the illustrated embodiment, the movable range R20 of the base nozzle 150A is 45 degrees from a predetermined reference axis A40 to one end and 45 degrees from the predetermined reference axis A40 to the other end (90 degrees in total). Also, the movable range R24 of the end nozzle 152A is 30 degrees from a center axis A44 of the base nozzle 150A to one end and 30 degrees from the center axis A44 to the other end (60 degrees in total). Similarly, in the illustrated embodiment, the movable range R22 of the base nozzle 150B is 45 degrees from a predetermined reference axis A42 to one end and 45 degrees from the predetermined reference axis A42 to the other end (90 degrees in total). Also, the movable range R26 of the end nozzle 152B is 30 degrees from a center axis A46 of the base nozzle 150B to one end and 30 degrees from the center axis A46 to the other end (60 degrees in total). In the illustrated embodiment, the predetermined reference axes A40 and A42 extend parallel to the longitudinal center axis CL and extend through the pivot axes A30 and A32, respectively. Of course, the movable ranges R20, R22, R24 and R26 can have a different range if needed and/or desired depending on the particular design of the boat 100.

In the illustrated embodiment, the steering 126 includes a gear mechanism that pulls and releases the cables of the steering links 146A and 146B in response to the steering operation of the steering 126. In the illustrated embodiment, the steering links 146A and 146B are non-connected to the end nozzles 152A and 152B. Thus, the steering operation of the steering 126 does not affect the orientations of the end nozzles 152A and 152B with respect to the base nozzles 150A and 150B. Thus, the base nozzles 150A and 150B can pivot in response to the steering operation of the steering 126 without changing the orientations of the end nozzles 152A and 152B with respect to the base nozzles 150A and 150B.

Specifically, FIGS. 12 to 14 illustrate the steering of the steering deflectors 144A and 144B in response to the steering operation of the steering 126 while the straight thrust mode is selected by the control switch 130. FIG. 12 illustrates the non-steered or neutral positions of the steering deflectors 144A and 144B (the base nozzles 150A and 150B) in the straight thrust mode. In the illustrated embodiment, as illustrated in FIG. 12, the center axes A44 and A46 of the base nozzles 150A and 150B are aligned with the predetermined reference axes A40 and A42, respectively, while the steering 126 is in a straight steering position for steering the boat 100 straight. In the illustrated embodiment, the predetermined reference axes A40 and A42 extend parallel to the longitudinal center axis CL. Thus, in the illustrated embodiment, the center axes A44 and A46 are oriented parallel to the longitudinal center axis CL while the steering 126 is in the straight steering position. While the straight thrust mode is selected, the base nozzles 150A and 150B are steered in the same direction by the same angle relative to the predetermined reference axes A40 and A42 according to the steering operation of the steering 126. For example, as illustrated in FIG. 13, when the steering 126 is turned in the counterclockwise direction to steer the boat 100 to the left, the cables of the steering links 146A and 146B are released, which turns the base nozzles 150A and 150B in the clockwise direction by steering angles R28 and R30, respectively. Also, as illustrated in FIG. 14, when the steering 126 is turned in the clockwise direction to steer the boat 100 to the right, the cables of the steering links 146A and 146B are pulled, which turns the base nozzles 150A and 150B in the counterclockwise direction by the steering angles R28 and R30, respectively. In the illustrated embodiment, the steering angle R28 is an angle defined between the predetermined reference axis A40 and the center axis A44 of the base nozzle 150A, while the steering angle R30 is an angle defined between the predetermined reference axis A42 and the center axis A46 of the base nozzle 150B.

As illustrated in FIGS. 12 to 14, in the straight thrust mode, center axes A48 and A50 of the end nozzles 152A and 152B are aligned with the center axes A44 and A46 of the base nozzles 150A and 150B, respectively, regardless of the steering operation of the steering 126. In the illustrated embodiment, the center axes A48 and A50 of the end nozzles 152A and 152B define propulsion axes of the jet propulsion units 116A and 116B in which propulsion forces are generated.

In the illustrated embodiment, the control switch 130 includes a gear mechanism that pulls and releases the cables of the deflector links 148A and 148B in response to the switching operation of the lever 132 of the control switch 130. In the illustrated embodiment, the control switch 130 is mechanically coupled to the end nozzles 152A and 152B of the steering deflectors 144A and 144B. In the illustrated embodiment, the deflector links 148A and 148B are non-connected to the base nozzles 150A and 150B. Thus, the switching operation of the control switch 130 does not affect the orientations of the base nozzles 150A and 150B with respect to the housings of the jet pumps 140A and 140B. Thus, the end nozzles 152A and 152B can pivot in response to the switching operation of the control switch 130 without changing the orientations of the base nozzles 150A and 150B with respect to the the housings of the jet pumps 140A and 140B.

FIG. 15 illustrates the non-steered or neutral positions of the steering deflectors 144A and 144B (the base nozzles 150A and 150B) in the toe-in thrust mode. In the illustrated embodiment, as illustrated in FIG. 15, the toe-in thrust mode is an operation mode in which the center axes A48 and A50 (e.g., the propulsion axes) converge as the center axes A48 and A50 extend rearwardly from the steering deflectors 144A and 144B while the steering 126 is in the straight steering position. Specifically, the toe-in thrust mode is selected when the lever 132 of the control switch 130 is positioned in the toe-in thrust mode position. More specifically, when the lever 132 is positioned in the toe-in thrust mode position, the cable of the deflector link 148A is released, which turns the end nozzle 152A in the counterclockwise direction about the pivot axis A34 by an offset angle R32. On the other hand, when the lever 132 is positioned in the toe-in thrust mode position, the cable of the deflector link 148B is pulled, which turns the end nozzle 152B in the clockwise direction about the pivot axis A36 by an offset angle R34. Thus, the steering deflectors 144A and 144B are oriented such that the center axes A48 and A50 converge as the center axes A48 and A50 extend rearwardly from the steering deflectors 144A and 144B while the steering 126 is in the straight steering position. In the illustrated embodiment, the offset angle R32 is an angle defined between the center axis A48 of the end nozzle 152A and the center axis A44 of the base nozzle 150A. Also, the offset angle R34 is an angle defined between the center axis A50 of the end nozzle 152B and the center axis A46 of the base nozzle 50B. In the illustrated embodiment, the offset angles R32 and R34 are equal to each other, and are set to an angle between 7 and 8 degrees, for example. However, the offset angles R32 and R34 can be a different value. For example, the offset angles R32 and R34 can be an angle that is more than or equal to 5 degrees and less than or equal to 30 degrees, for example.

With the above-mentioned configuration, the jet propulsion units 116A and 116B generate the propulsion forces along the center axes A48 and A50, respectively. In the illustrated embodiment, the offset angles R32 and R34 are equal to each other. Thus, the resultant force of the propulsion forces propels the boat 100 straight when the propulsion forces have the same magnitude. Also, in this case, the water jets ejected from the steering deflectors 144A and 144B converge behind the boat 100, which creates the boat's wake WK that is relatively higher in the height and shorter in the length, for example.

FIG. 16 illustrates the non-steered or neutral positions of the steering deflectors 144A and 144B (the base nozzles 150A and 150B) in the toe-out thrust mode. In the illustrated embodiment, as illustrated in FIG. 16, the toe-out thrust mode is an operation mode in which the center axes A48 and A50 (e.g., the propulsion axes) diverge as the center axes A48 and A50 extend rearwardly from the steering deflectors 144A and 144B while the steering 126 is in the straight steering position. Specifically, the toe-out thrust mode is selected when the lever 132 of the control switch 130 is positioned in the toe-out thrust mode position. More specifically, when the lever 132 is positioned in the toe-out thrust mode position, the cable of the deflector link 148A is pulled, which turns the end nozzle 152A in the clockwise direction about the pivot axis A34 by the offset angle R32. On the other hand, when the lever 132 is positioned in the toe-out thrust mode position, the cable of the deflector link 148B is released, which turns the end nozzle 152B in the counterclockwise direction about the pivot axis A36 by the offset angle R34. Thus, the steering deflectors 144A and 144B are oriented such that the center axes A48 and A50 diverge as the center axes A48 and A50 extend rearwardly from the steering deflectors 144A and 144B while the steering 126 is in the straight steering position. In the illustrated embodiment, the offset angles R32 and R34 are equal to each other, and are set to an angle between 7 and 8 degrees, for example. However, the offset angles R32 and R34 can be a different value. For example, the offset angles R32 and R34 can be an angle that is more than or equal to 5 degrees and less than or equal to 30 degrees, for example.

With the above-mentioned configuration, the jet propulsion units 116A and 116B generate the propulsion forces along the center axes A48 and A50, respectively. In the illustrated embodiment, the offset angles R32 and R34 are equal to each other. Thus, the resultant force of the propulsion forces propels the boat 100 straight when the propulsion forces have the same magnitude. Also, in this case, the water jets ejected from the steering deflectors 144A and 144B diverge behind the boat 100, which creates the boat's wake WK that is relatively shorter in the height and longer in the length, for example.

In the illustrated embodiment, the steering links 146A and 146B and the deflector links 148A and 148B each include a cable or wire (e.g., a Bowden cable). However, the steering links 146A and 146B can alternatively include a hydraulic circuit that links the steering 126 and the base nozzles 150A and 150B. Also, the deflector links 148A and 148B can alternatively include a hydraulic circuit that links the control switch 130 and the end nozzles 152A and 152B.

Third Embodiment

Figure 17:
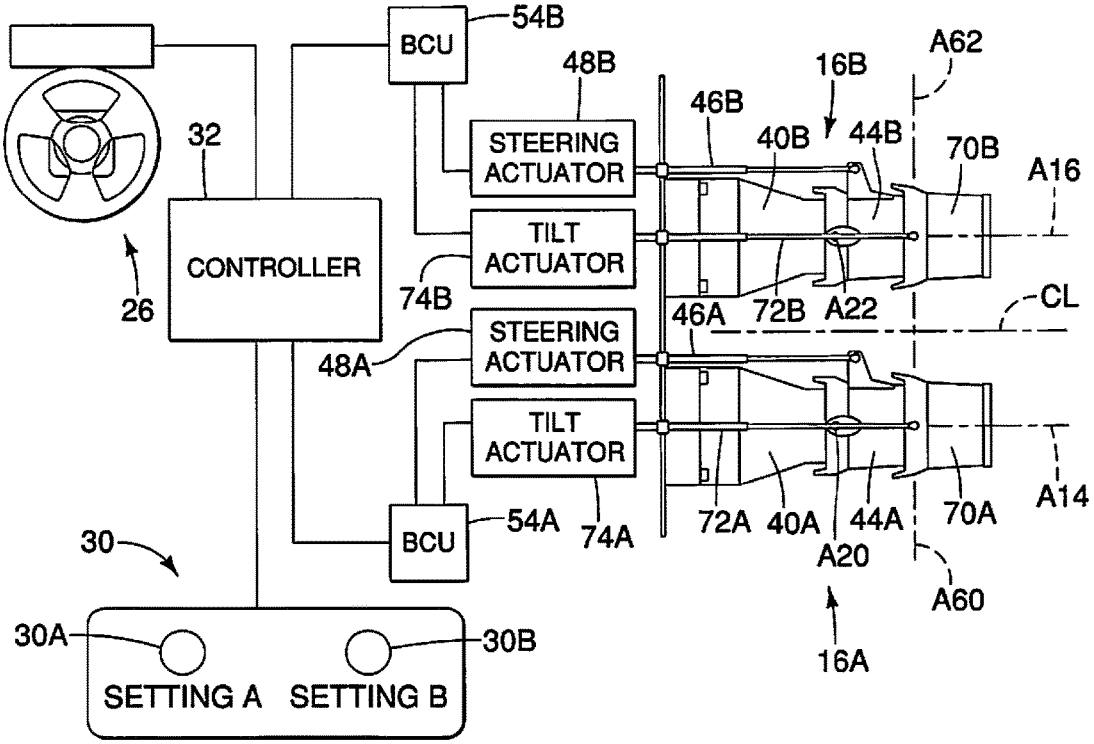
FIG. 17 is a schematic diagram of an electric control system for adjusting a tilt of steering nozzles in accordance with a third embodiment.

Referring now to FIG. 17, a boat 10 (FIG. 1) in accordance with a third embodiment will now be explained. The boat 10 in accordance with the third embodiment is basically identical to the boat 10 in accordance with the first embodiment, except that a tilt of at least one of the jet propulsion units 16A and 16B is adjustable. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

In the third embodiment, the left side jet propulsion unit 16A further includes a tilt deflector 70A, a deflector link 72A, and a tilt actuator 74A. The tilt deflector 70A is pivotally coupled to the steering nozzle 44A. The tilt deflector 70A is tiltable relative to the steering nozzle 44A about a tilt axis A60. The tilt axis A60 extends in the widthwise direction W of the boat 10. Thus, the tilt deflector 70A pivots upward and downward in the vertical direction of the boat 10 with respect to the steering nozzle 44A. With this configuration, the tilt of the propulsion axis A14 of the left side jet propulsion unit 16A with respect to the vertical direction can be adjusted.

The deflector link 72A includes a cable or wire (e.g., a Bowden cable) that mechanically links the tilt deflector 70A with the tilt actuator 74A. The tilt actuator 74A includes a motor or other type of actuator that operates the tilt deflector 70A via the deflector link 72A in response to the control signal from the controller 32. Of course, the deflector link 72A can alternatively include a hydraulic cylinder that links the tilt deflector 70A with the tilt actuator 74A. In this case, the tilt actuator 74A includes a hydraulic pump that operates the tilt deflector 70A via the deflector link 72A in response to the control signal from the controller 32.

Similarly, in the illustrated embodiment, the right side jet propulsion unit 16B further includes a tilt deflector 70B, a deflector link 72B, and a tilt actuator 74B. The tilt deflector 70B is pivotally coupled to the steering nozzle 44B. The tilt deflector 70B is tiltable relative to the steering nozzle 44B about a tilt axis A62. The tilt axis A62 extends in the widthwise direction W of the boat 10. Thus, the tilt deflector 70B pivots upward and downward in the vertical direction of the boat 10 with respect to the steering nozzle 44B. With this configuration, the tilt of the propulsion axis A16 of the right side jet propulsion unit 16B with respect to the vertical direction can be adjusted.

The deflector link 72B includes a cable or wire (e.g., a Bowden cable) that mechanically links the tilt deflector 70B with the tilt actuator 74B. The tilt actuator 74B includes a motor or other type of actuator that operates the tilt deflector 70B via the deflector link 72B in response to the control signal from the controller 32. Of course, the deflector link 72B can alternatively include a hydraulic cylinder that links the tilt deflector 70B with the tilt actuator 74B. In this case, the tilt actuator 74B includes a hydraulic pump that operates the tilt deflector 70B via the deflector link 72B in response to the control signal from the controller 32.

The controller 32 operates the tilt actuators 74A and 74B in response to the switching operation of the control switch 30. In the illustrated embodiment, the controller 32 operates the tilt actuators 74A and 74B to adjust the tilt of the tilt deflectors 70A and 70B, respectively, according to the operation mode selected by the control switch 30. In the illustrated embodiment, tilt angles of the tilt deflectors 70A and 70B corresponding to the operation modes (the straight thrust mode, the toe-in thrust mode, and the toe-out thrust mode) are preset and pre-stored in the memory of the controller 32. When the controller 32 determines the selected operation mode based on the operation signal from the control switch 30, the controller 32 further determines the tilt angles of the tilt deflectors 70A and 70B based on the selected operation mode. Then, the controller 32 operates the tilt actuators 74A and 74B to pivot the tilt deflectors 70A and 70B relative to the steering nozzles 44A and 44B according to the tilt angles. At the same timing, the controller 32 also operates the steering actuators 48A and 48B to turn the steering nozzles 44A and 44B about the steering axes A20 and A22, respectively, and to change the non-steered or neutral positions of the steering nozzles 44A and 44B according to the selected operation mode (FIGS. 7 to 9). With this configuration, the directions of the water jets ejected from the jet propulsion units 16A and 16B can be horizontally and vertically adjusted. Thus, the boat's wake WK created by the water jets can be precisely adjusted as desired for various surface water sports.

In the illustrated embodiment, the control switch 30 is operatively coupled to the jet propulsion units 16A and 16B (e.g., at least one of the first and second jet propulsion units) via the controller 32 to adjust the tilts of the propulsion axes A14 and A16 (e.g., at least one of the first and second propulsion axes) with respect to the vertical direction.

In the illustrated embodiment, the control switch 30 can adjusts the tilts of the propulsion axes A14 and A16 by different tilt angles, respectively. For example, the controller 32 can operate the tilt actuators 74A and 74B to pivot the steering nozzle 44A upward and to pivot the steering nozzle 44B downward, and vice versa.

In the illustrated embodiment, the controller 32 can also operate the tilt actuators 74A and 74B to adjust the tilts of the steering nozzles 44A and 44B while the straight thrust mode is selected. In this case, the jet propulsion units 16A and 16B generates the desired boat's wake WK solely by adjusting the tilts of the tilt deflectors 70A and 70B without changing the non-steered or neutral positions of the steering nozzles 44A and 44B. Also, the boat 10 can have a single jet propulsion configuration with a single tiltable jet propulsion unit. With this single jet propulsion unit, the boat's wake WK can be enhanced by changing the tilt of the jet propulsion unit.

Fourth Embodiment

Figure 18:
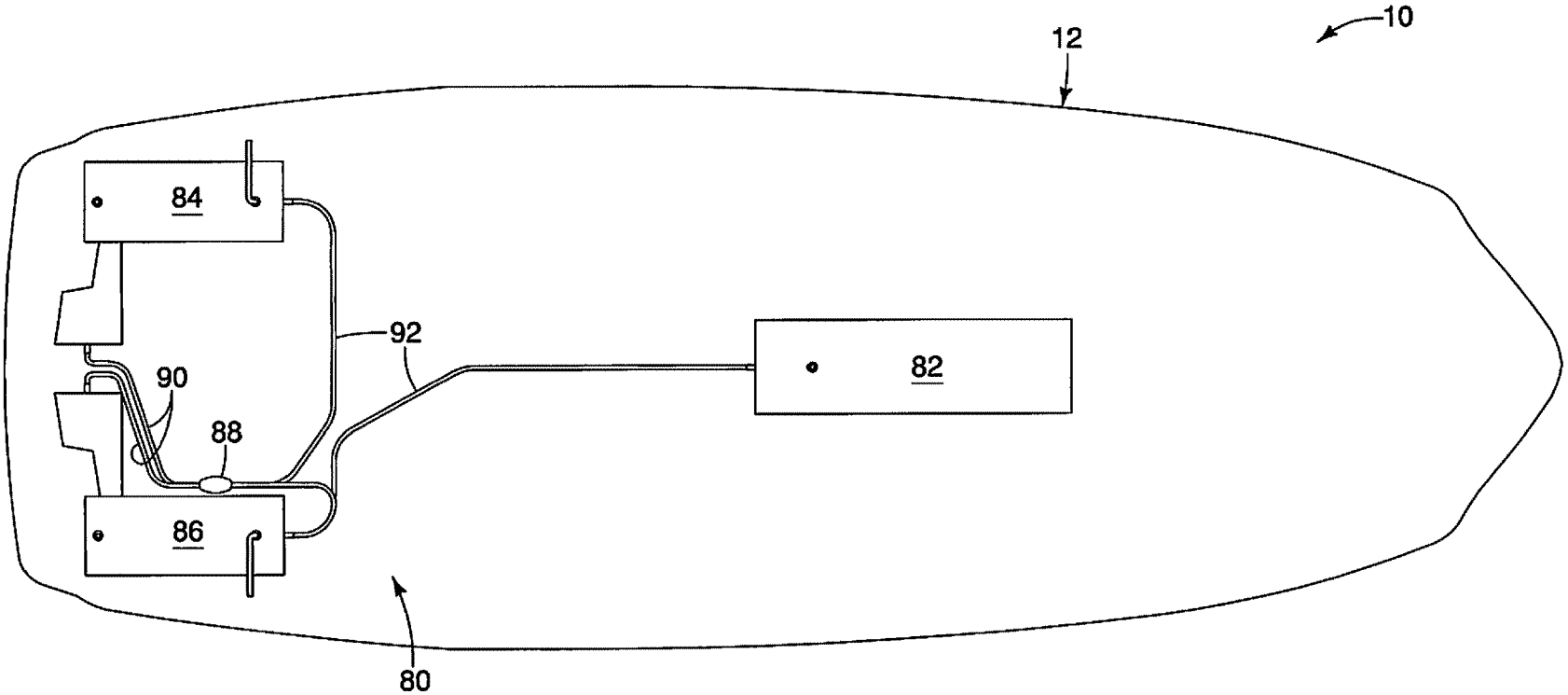
FIG. 18 is a schematic diagram of a hydraulic circuit of a ballast system.

Referring now to FIG. 18, a boat 10 (FIG. 1) in accordance with a fourth embodiment will now be explained. The boat 10 in accordance with the fourth embodiment is basically identical to the boat 10 in accordance with the first embodiment, except that the boat 10 in accordance with the fourth embodiment further includes a ballast system 80. In view of the similarity between the first and fourth embodiments, the parts of the fourth embodiment that are identical to the parts of the first embodiment will be given the same reference numerals as the parts of the first embodiment. Moreover, the descriptions of the parts of the fourth embodiment that are identical to the parts of the first embodiment may be omitted for the sake of brevity.

The ballast system 80 includes a plurality of (three in FIG. 18) ballast tanks or bags 82, 84 and 86 (e.g., ballast weights), a ballast pump 88, a plurality of intake pipes 90, and a plurality of distribution pipes 92. The ballast system 80 is installed inside the hull 12 of the boat 10. In the illustrated embodiment, the ballast system 80 is the so-called three tank system having the ballast tank 82 in the center of the boat 10 and the ballast tanks 84 and 86 in the rear of the boat 10 on either side of an engine compartment, for example. The ballast tanks 82, 84 and 86 are filled with water using the ballast pump 88. In particular, the ballast pump 88 draws the water through the intake pipes 90, and distribute the water to the ballast tanks 82, 84 and 86 through the distribution pipes 92. Also, the ballast pump 88 adjusts the amount of water distributed to the ballast tanks 82, 84 and 86 to change the weight distribution of the boat 10.

In the illustrated embodiment, the ballast pump 88 is electrically coupled to the controller 32. The controller 32 operates the ballast pump 88 to adjust the amount of water in each of the ballast tanks 82, 84 and 86 according to the selected operation mode selected by the control switch 30. Thus, in the illustrated embodiment, the boat 10 includes the ballast system 80 having the ballast tanks 82, 84 and 86 that are adjustable based on the selected operation mode of the jet propulsion units 16A and 16B.

Generally, when filling the ballast tanks 82, 84 and 86 with water, the hull 12 has a lower center of gravity, which increases wake. Also, generally, the more weight in the rear of the boat 10 creates a higher wake in height, and vice versa if there is more weight in the front or less weight in the rear. In the illustrated embodiment, when the toe-in thrust mode is selected, the controller 32 operates the ballast pump 88 to add more weight in the rear of the boat 10 to further increase the height of the boat's wake WK, for example. On the other hand, when the toe-out thrust mode is selected, the controller 32 operates the ballast pump 88 to add more weight in the front of the boat 10 or add less weight in the rear of the boat 10 to decrease or change the height of the boat's wake WK, for example. However, the ballast weight distribution according the selected operation mode selected by the control switch 30 is not limited to this. The controller 32 can differently operate the ballast pump 88 to adjust the ballast weight distribution as needed and/or desired. For example, in either modes (the toe-in thrust mode and the toe-out thrust mode), the controller 32 can operate the ballast pump 88 to adjust the ballast weight distribution according to the skill level of the rider RD.

The present invention is not limited the illustrated embodiments described above, and it is also possible to make various modifications.

Figure 19:
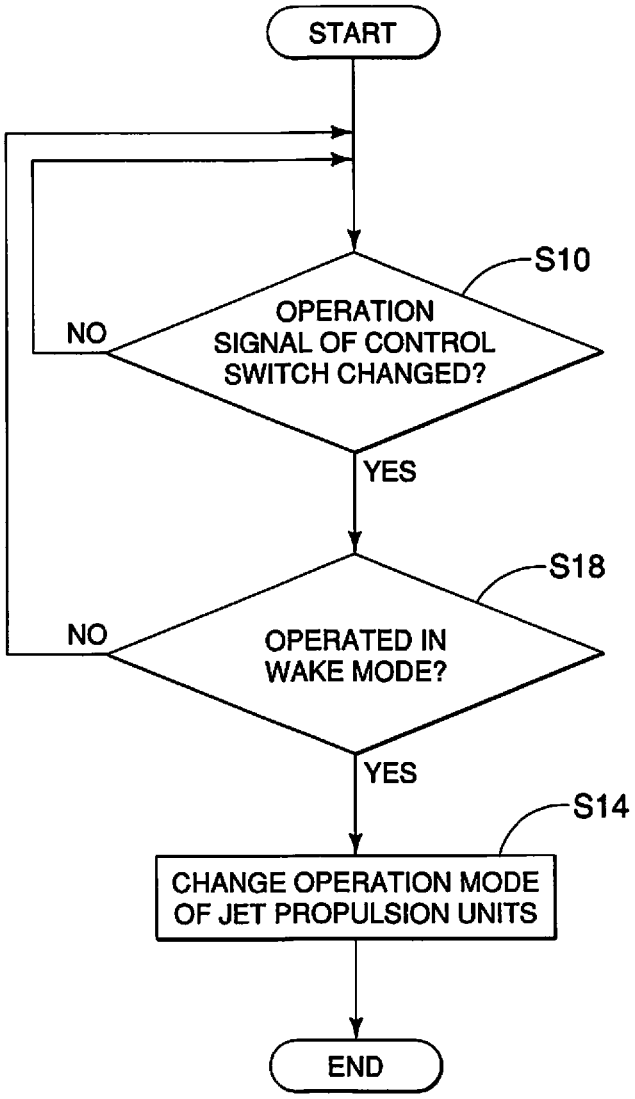
FIG. 19 is a flowchart of a processing for changing an operation mode of the jet propulsion units in accordance with yet another modification example.

In the illustrated embodiment, as illustrated in FIGS. 10 and 11, the controller 32 can be configured to change the operation mode of the jet propulsion units 16A and 16B only when predetermined conditions are satisfied. However, the predetermined conditions can be different from the above-mentioned conditions in FIGS. 10 and 11. For example, as illustrated in FIG. 19, the controller 32 can be configured to change the operation mode of the jet propulsion units 16A and 16B and operate the steering nozzles 44A and 44B upon satisfying following conditions: detecting that the user operation (e.g., the user input) specifies the change in the operation mode of the jet propulsion units 16A and 16B, and detecting that the boat 10 is traveling or cruising in a predetermined speed-control or wake mode. Specifically, the "wake mode" is an automatic speed-control mode for operating the boat 10 at a preset steady speed while enhancing the boat's wake WK. For example, the wake mode can be engaged when a user or operator presses a wake mode button that is provided in the cockpit 20 or displayed on a touch screen display while the throttles are at idle speed and the shift is in the neutral position. The user or operator can preset a speed and an acceleration for the wake mode. Once the wake mode is engaged and the user or operator operates the remote control 28 for fully accelerating the engines 42A and 42B, then the boat 10 is automatically accelerated at the preset acceleration until reaching the preset speed. Once the boat 10 reaches the preset speed, then the controller 32 determines that the boat 10 is being operated in the wake mode. The wake mode can be canceled by pressing the wake mode button again or move the remote control 28 to a slower engine speed, for example.

The processing illustrated in FIG. 19 is basically identical to the processing illustrated in FIG. 10, except that the controller 32 determines whether the boat 10 is being operated in the above-mentioned wake mode (step S18). Specifically, the controller 32 executes the above-mentioned step S10. If the operation signal of the control switch 30 indicates the operation of the button 30A or 30B or the reset of the button 30A or 30B (YES in step S10), then the controller 32 further determines whether the boat 10 is being operated in the wake mode (step S18). If the controller 32 determines that the boat 10 is being operated in the wake mode (YES in step S18), then the controller 32 changes the operation mode of the jet propulsion units 16A and 16B (step S14). On the other hand, if the operation signal of the control switch 30 does not indicate the operation of the button 30A or 30B or the reset of the button 30A or 30B (NO in step S10), or if the boat 10 is not operated in the wake mode (NO in step S18), then the controller 32 does not change the operation mode of the jet propulsion units 16A and 16B, and the process goes back to step S10. With this configuration, while the boat 10 is traveling at a steady speed in the wake mode, the operation mode of the jet propulsion units 16A and 16B can be changed. Thus, the rider RD can enjoy different boat's wake WK created by different operation modes while continuously riding the boat's wake WK (without stop riding the boat's wake WK). In this example, optionally, when the determination result in step S18 is negative (NO in step S18), then the controller 32 can display a message on a display (not shown) to prompt the user or operator to operate the boat 10 in the wake mode.

Figure 20:
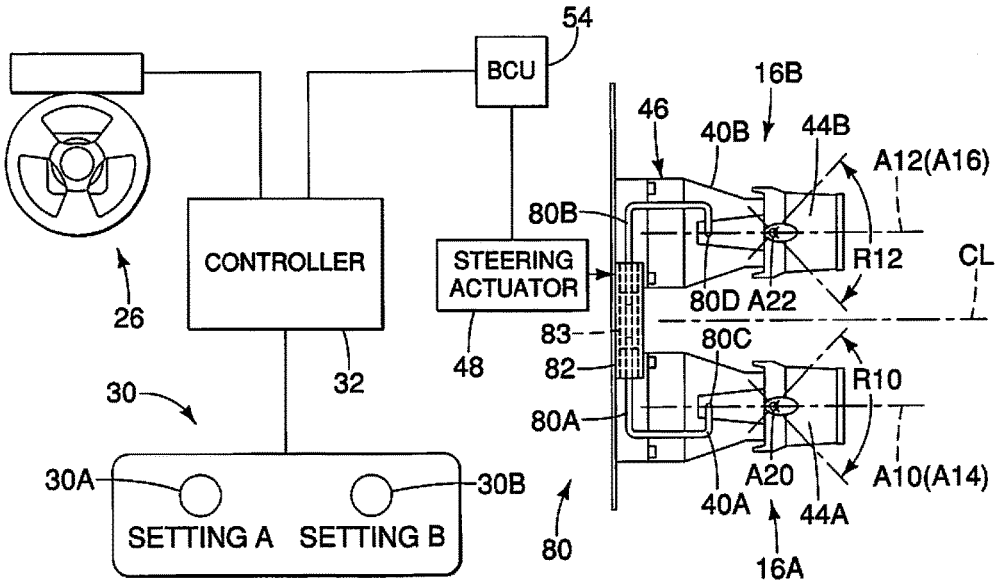
FIG. 20 is a schematic diagram of an electric control system for operating steering nozzles together with a steering actuator.

In the above-mentioned embodiment, as illustrated in FIGS. 7 to 9, the steering nozzles 44A and 44B are independently steered by the steering actuators 48A and 48B in response to the steering operation of the steering 26. However, the steering nozzles 44A and 44B can be mechanically linked or interlocked with each other, and be steered together in response to the steering operation of the steering 26. Specifically, as illustrated in FIG. 20, the steering nozzles 44A and 44B are mechanically linked by a steering link 46 that is operated by a steering actuator 48. The configurations illustrated in FIG. 20 are basically identical to the configurations of the first embodiment illustrated in FIGS. 7 to 9, except for the steering link 46 and the steering actuator 48. Thus, the descriptions of the parts shown in FIG. 20 that are identical to the parts of the first embodiment may be omitted for the sake of brevity.

As illustrated in FIG. 20, the steering link 46 includes a rod assembly 80 and a cylinder 82. The rod assembly 80 has a pair of steering rods 80A and 80B and a coupling 83. The steering actuator 48 includes at least one motor or other type of actuator that operates the steering link 46 in response to the control signal from the controller 32. One end portions of the steering rods 80A and 80B are coupled together with a spacing therebetween by the coupling 83. The one end portions of the steering rods 80A and 80B and the coupling 83 are slidably disposed inside the cylinder 82. The cylinder 82 is fixedly coupled to the hull 12 in a conventional manner. In the illustrated embodiment, the cylinder 82 is coupled to the hull 12 such that a center axis of the cylinder 82 extends parallel to the widthwise direction W of the boat 10. The other end portions of the steering rods 80A and 80B are pivotally coupled to extensions of the steering nozzles 44A and 44B at pivots 80C and 80D. The motor of the steering actuator 48 is mechanically coupled to the rod assembly 80 via a gear mechanism (not shown) to slide the rod assembly 80 relative to the cylinder 82. Specifically, when the steering 26 is turned to steer the boat 10 to the left, the controller 32 operates the steering actuator 48 to slide the rod assembly 80 to the right with respect to the cylinder 82, which pivots the steering nozzles 44A and 44B together in the clockwise direction. On the other hand, when the steering 26 is turned to steer the boat 10 to the right, the controller 32 operates the steering actuator 48 to slide the rod assembly 80 to the left with respect to the cylinder 82, which pivots the steering nozzles 44A and 44B together in the counterclockwise direction.

The coupling 83 includes a thread coupling that are threadedly coupled with the one end portions of the steering rods 80A and 80B. The spacing between the one end portions of the steering rods 80A and 80B are adjustable by rotating the coupling 83 with respect to the one end portions of the steering rods 80A and 80B, which also adjusts the spacing between the pivots 80C and 80D in the widthwise direction. In the illustrated embodiment, the motor of the steering actuator 48 is mechanically coupled to the coupling 83 via a gear mechanism (not shown) to rotate the coupling 83 relative to the one end portions of the steering rods 80A and 80B. When the button 30A corresponding to the toe-in thrust mode is operated while the steering 26 is in the straight steering position, the controller 32 operates the steering actuator 48 to rotate the coupling 83 relative to the one end portions of the steering rods 80A and 80B such that the rod assembly 80 extends. This increases the spacing between the pivots 80C and 80D in the widthwise direction, and pivots the steering nozzle 44A in the counterclockwise direction and the steering nozzle 44B in the clockwise direction. On the other hand, when the button 30B corresponding to the toe-out thrust mode is operated while the steering 26 is in the straight steering position, the controller 32 operates the steering actuator 48 to rotate the coupling 83 relative to the one end portions of the steering rods 80A and 80B such that the rod assembly 80 contracts. This decreases the spacing between the pivots 80C and 80D in the widthwise direction, and pivots the steering nozzle 44A in the clockwise direction and the steering nozzle 44B in the counterclockwise direction.

In the illustrated embodiment illustrated in FIG. 20, the steering actuator 48 includes at least one motor. However, of course, the steering actuator 48 can includes a hydraulic pump and the cylinder 82 includes a hydraulic cylinder. Also, the steering link 46 can include a conventional mechanism that absorbs the displacements of the pivots 80C and 80D in the lengthwise direction L due to the pivot movements of the steering nozzles 44A and 44B.

Figure 21:
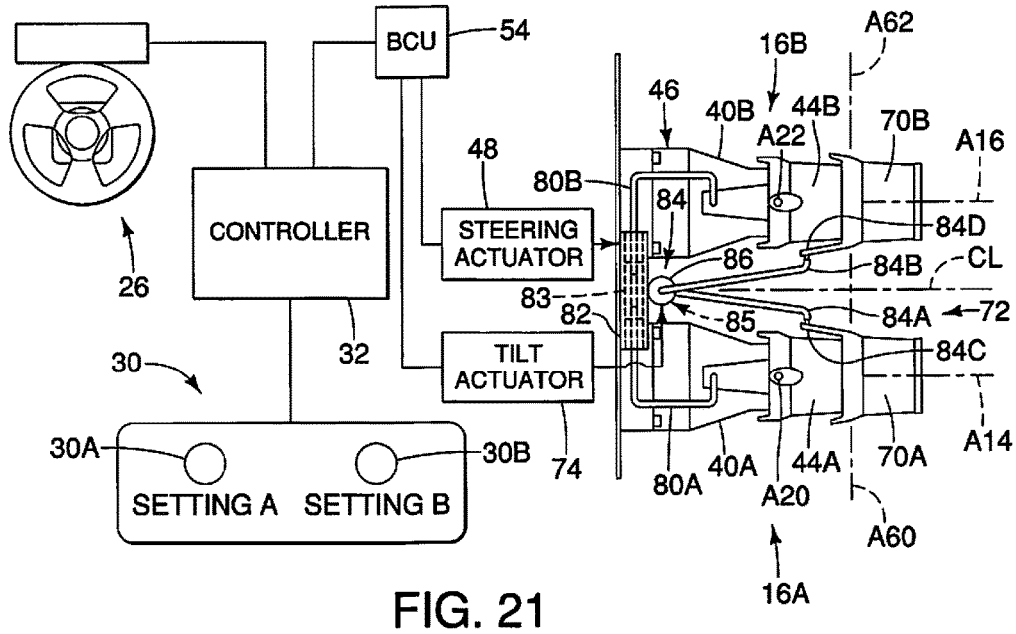
FIG. 21 is a schematic diagram of an electric control system for adjusting a tilt of steering nozzles together with a tilt actuator.

Similarly, in the above-mentioned embodiment, as illustrated in FIG. 17, the steering nozzles 44A and 44B are independently steered by the steering actuators 48A and 48B in response to the steering operation of the steering 26. Also, as illustrated in FIG. 17, the tilt deflectors 70A and 70B are independently tilted by the tilt actuators 74A and 74B in response to the control signal from the controller 32. However, in the illustrated embodiment, as illustrated in FIG. 21, the steering nozzles 44A and 44B can be mechanically linked or interlocked with each other, and be steered together in response to the steering operation of the steering 26. Also, as illustrated in FIG. 21, the tilt deflectors 70A and 70B can be mechanically linked or interlocked with each other, and be tilted together in response to the control signal from the controller 32. The configurations of the steering link 46 and the steering actuator 48 for steering the steering nozzles 44A and 44B together is basically identical to the steering link 46 and the steering actuator 48 illustrated in FIG. 20. Thus, the detailed description of the steering link 46 and the steering actuator 48 will be omitted for the sake of brevity.

As illustrated in FIG. 21, the tilt deflectors 70A and 70B are mechanically linked by a deflector link 72 that is operated by a tilt actuator 74. The configurations of the deflector link 72 is basically identical to the configurations of steering link 46 illustrated in FIG. 20, except for the orientation of the deflector link 72 relative to the hull 12.

Specifically, as illustrated in FIG. 21, the deflector link 72 includes a rod assembly 84 and a cylinder 86. The rod assembly 84 has a pair of tilt rods 84A and 84B and a coupling 85. The tilt actuator 74 includes at least one motor or other type of actuator that operates the deflector link 72 in response to the control signal from the controller 32. One end portions of the tilt rods 84A and 84B are coupled together by the coupling 85 with a spacing therebetween. The one end portions of the tilt rods 84A and 84B and the coupling 85 are slidably disposed inside the cylinder 86. The cylinder 86 is fixedly coupled to the hull 12 in a conventional manner. In the illustrated embodiment, the cylinder 86 is coupled to the hull 12 such that a center axis of the cylinder 86 extends parallel to the vertical direction of the boat 10. The other end portions of the tilt rods 84A and 84B are pivotally coupled to extensions of the tilt deflectors 70A and 70B at pivots 84C and 84D. Specifically, in the illustrated embodiment, the tilt rod 84A rearwardly extends out from a lower end of the cylinder 86, and connected to the extension of the tilt deflectors 70A at the pivot 84C. Also, the tilt rod 84B rearwardly extends out from an upper end of the cylinder 86, and connected to the extension of the tilt deflectors 70B at the pivot 84D. However, of course, the configuration can be such that the tilt rod 84A rearwardly extends out from the upper end of the cylinder 86, while the tilt rod 84B rearwardly extends out from the lower end of the cylinder 86. The motor of the tilt actuator 74 is mechanically coupled to the rod assembly 84 via a gear mechanism (not shown) to slide the rod assembly 84 relative to the cylinder 86. Specifically, in order to tilt the tilt deflectors 70A and 70B upward, the controller 32 operates the tilt actuator 74 to slide the rod assembly 84 downward in the vertical direction. On the other hand, in order to tilt the tilt deflectors 70A and 70B downward, the controller 32 operates the tilt actuator 74 to slide the rod assembly 84 upward in the vertical direction.

The coupling 85 includes a thread coupling that are threadedly coupled with the one end portions of the tilt rods 84A and 84B. The spacing between the one end portions of the tilt rods 84A and 84B are adjustable by rotating the coupling 85 with respect to the one end portions of the tilt rods 84A and 84B, which also adjusts the spacing between the pivots 84C and 84D in the vertical direction. In the illustrated embodiment, the motor of the tilt actuator 74 is mechanically coupled to the coupling 85 via a gear mechanism (not shown) to rotate the coupling 85 relative to the one end portions of the tilt rods 84A and 84B. Thus, in order to pivot the tilt deflector 70A upward and the tilt deflector 70B downward, the controller 32 operates the tilt actuator 74 to rotate the coupling 85 relative to the one end portions of the tilt rods 84A and 84B such that the rod assembly 84 extends. This increases the spacing between the pivots 84C and 84D in the vertical direction, and pivots the tilt deflector 70A upward and the tilt deflector 70B downward. On the other hand, in order to pivot the tilt deflector 70A downward and the tilt deflector 70B upward, the controller 32 operates the tilt actuator 74 to rotate the coupling 85 relative to the one end portions of the tilt rods 84A and 84B such that the rod assembly 84 contracts. This decreases the spacing between the pivots 84C and 84D in the vertical direction, and pivots the tilt deflector 70A downward and the tilt deflector 70B upward.

In the illustrated embodiment illustrated in FIG. 21, the tilt actuator 74 includes at least one motor. However, of course, the tilt actuator 74 can includes a hydraulic pump and the cylinder 86 includes a hydraulic cylinder. Also, the deflector link 72 can include a conventional mechanism that absorbs the displacements of the pivots 84C and 84D in the lengthwise direction L due to the pivot movements of the tilt deflectors 70A and 70B.

In the illustrated embodiments, the boat 10 (100) has a twin inboard jet configuration (the left side jet propulsion unit 16A (116A) and the right side jet propulsion unit 16B (16B)). However, the configuration of the jet propulsion unit for the boat 10 (100) is not limited to this configuration. The boat 10 (100) can have only a single jet propulsion unit, or can have three or more jet propulsion units.

In the illustrated embodiments, the boat 10 (100) has an inboard jet configuration. However, the configuration of the jet propulsion unit for the boat 10 (100) is not limited to this configuration. The boat 10 (100) can have an outboard jet configuration.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Thus, as used herein, the singular forms "a," "an" and "the" are intended to include the plural forms as well, unless the context clearly indicates otherwise. Also, the terms "part," "section," "portion," "member" or "element" when used in the singular can have the dual meaning of a single part or a plurality of parts. Unless otherwise defined, all terms (including technical and scientific terms) used herein have the same meaning as commonly understood by one of ordinary skill in the art to which illustrative embodiments of the inventive concepts belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. As used herein the term "and/or" includes any and all combinations of one or more of the associated listed items. Additionally, similar words used to describe the relationship between elements or layers should be interpreted in a like fashion (e.g., "between" versus "directly between", "above" versus "directly above", "below" versus "directly below", "adjacent" versus "directly adjacent," "on" versus "directly on"). Thus, components that are shown directly connected or contacting each other can have intermediate structures disposed between them unless specified otherwise.

Spatially relative terms, such as "forward", "rearward", "above", "below", "beneath", "downward", "vertical", "horizontal", and "transverse" as well as any other similar spatial terms may be used herein for the ease of description to describe one element or feature's relationship to another element(s) or feature(s) of the above embodiments. These terms, as utilized to describe the present invention should be interpreted relative to a boat floating in calm water. The terms "left" and "right" are used to indicate the "right" when referencing from the right side as viewed from the rear of the boat, and the "left" when referencing from the left side as viewed from the rear of the boat.

Also it will be understood that although the terms "first" and "second" may be used herein to describe various components these components should not be limited by these terms. These terms are only used to distinguish one component from another. Thus, for example, a first component discussed above could be termed a second component and vice-a-versa without departing from the teachings of the present invention. The terms of degree such as "substantially", "about" and "approximately" as used herein mean an amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A jet boat comprising:

a hull;

a first let propulsion unit provided to the hull, the first jet propulsion unit having a first steering deflector with a first propulsion axis, the first steering deflector being movable with respect to the hull;

a second let propulsion unit provided to the hull, the second let propulsion unit having a second steering deflector with a second propulsion axis, the second steering deflector being movable with respect to the hull; and a steering unit operatively coupled to the first and second jet propulsion units, the first and second steering deflectors being oriented such that the first and second propulsion axes are non-parallel to a longitudinal center axis of the hull while the steering unit is in a straight steering position, the first and second steering deflectors being oriented such that the first and second propulsion axes are laterally and oppositely inclined with respect to the longitudinal center axis while the steering unit is in the straight steering position, and the first and second steering deflectors being oriented such that the first and second propulsion axes converge as the first and second propulsion axes extend rearwardly from the first and second steering deflectors while the steering unit is in the straight steering position.

2. A jet boat comprising a hull;

a first jet propulsion unit provided to the hull, the first jet propulsion unit having a first steering deflector with a first propulsion axis, the first steering deflector being movable with respect to the hull;

a second jet propulsion unit provided to the hull, the second jet propulsion unit having a second steering deflector with a second propulsion axis, the second steering deflector being movable with respect to the hull;

a steering unit operatively coupled to the first and second let propulsion units; and a user control switch operatively coupled to the first and second jet propulsion units to move the first and second steering deflectors independently from the steering unit, the first and second steering deflectors being oriented such that the first and second propulsion axes are non-parallel to a longitudinal center axis of the hull while the steering unit is in a straight steering position.

3. The jet boat according to claim 2, further comprising the user control switch includes an electronic controller that is electrically coupled to the first and second jet propulsion units to operate the first and second steering deflectors.

4. The jet boat according to claim 2, wherein the user control switch is mechanically coupled to the first and second steering deflectors.

5. The jet boat according to claim 2, wherein the user control switch is further configured to switch an operation mode of the first and second jet propulsion units between a straight thrust mode in which the first and second propulsion axes are oriented parallel to the longitudinal center axis while the steering unit is in the straight steering position, and an inclined thrust mode in which the first and second propulsion axes are laterally and oppositely inclined with respect to the longitudinal center axis while the steering unit is in the straight steering position.

6. The jet boat according to claim 5, wherein the user control switch is further configured to switch the inclined thrust mode of the first and second jet propulsion units between different inclined thrust modes with different offset angles of the first and second propulsion axes with respect to the longitudinal center axis.

7. The jet boat according to claim 5, wherein the user control switch is further configured to switch the inclined thrust mode of the first and second jet propulsion units between a toe-in thrust mode in which the first and second propulsion axes converge as the first and second propulsion axes extend rearwardly from the first and second steering deflectors, and a toe-out thrust mode in which the first and second propulsion axes diverge as the first and second propulsion axes extend rearwardly from the first and second steering deflectors.

8. The jet boat according to claim 5, further comprising a ballast system having a ballast weight that is adjustable based on the operation mode of the first and second jet propulsion units.

9. The jet boat according to claim 3, wherein the electronic controller is configured operate the first and second steering deflectors upon satisfying following conditions: detecting a user input specifies a change in an operation mode of the first and second jet propulsion units, and detecting a shift position of the jet boat is located at a neutral position.

10. The jet boat according to claim 3, wherein the electronic controller is configured to operate the first and second steering deflectors upon satisfying following conditions: detecting a user input specifies a change in an operation mode of the first and second jet propulsion units, detecting a shift position of the jet boat is located at a neutral position, and detecting an engine rotational speed falls within a predetermined range.

11. A jet boat comprising:

a hull;

a first jet propulsion unit provided to the hull, the first jet propulsion unit having a first steering deflector with a first propulsion axis, the first steering deflector being movable with respect to the hull;

a second jet propulsion unit provided to the hull, the second jet propulsion unit having a second steering deflector with a second propulsion axis, the second steering deflector being movable with respect to the hull; and a user control switch operatively coupled to at least one of the first and second jet propulsion units to adjust a tilt of at least one of the first and second propulsion axes with respect to a vertical direction.

12. The jet boat according to claim 11, wherein the user control switch is operatively coupled to the first and second jet propulsion units to adjust tilts of the first and second propulsion axes with respect to the vertical direction.

13. The jet boat according to claim 12, wherein the user control switch is configured to adjust the tilts of the first and second propulsion axes by different tilt angles, respectively.

14. The jet boat according to claim 11, further comprising a steering unit operatively coupled to the first and second steering deflectors of the first and second jet propulsion units, the first and second steering deflectors being oriented such that the first and second propulsion axes are non-parallel to a longitudinal center axis of the hull while the steering unit is in a straight steering position.

15. The jet boat according to claim 14, wherein the first and second steering deflectors are oriented such that the first and second propulsion axes are laterally and oppositely inclined with respect to the longitudinal center axis while the steering unit is in the straight steering position.

16. The jet boat according to claim 15, wherein the first and second steering deflectors are oriented such that the first and second propulsion axes converge as the first and second propulsion axes extend rearwardly from the first and second steering deflectors while the steering unit is in the straight steering position.

17. The jet boat according to claim 14, wherein the user control switch is further configured to move the first and second steering deflectors independently from the steering unit.

18. The jet boat according to claim 17, wherein the user control switch is further configured to switch an operation mode of the first and second jet propulsion units between a straight thrust mode in which the first and second propulsion axes are oriented parallel to the longitudinal center axis while the steering unit is in the straight steering position, and an inclined thrust mode in which the first and second propulsion axes are laterally and oppositely inclined with respect to the longitudinal center axis while the steering unit is in the straight steering position.

* * * * *